US009845597B1

(12) United States Patent
Shaw et al.

(10) Patent No.: US 9,845,597 B1
(45) Date of Patent: Dec. 19, 2017

(54) TENSION MOUNTED FIRE BARRIER ASSEMBLY

(71) Applicant: InPro Corporation, Muskego, WI (US)

(72) Inventors: Alan Shaw, Lockport, NY (US); George Matthew Fisher, New Berlin, WI (US); Matthew G. Bennett, New Berlin, WI (US)

(73) Assignee: InPro Corporation, Muskego, WI (US)

( * ) Notice: Subject to any disclaimer, the term of this patent is extended or adjusted under 35 U.S.C. 154(b) by 0 days.

(21) Appl. No.: 15/453,000

(22) Filed: Mar. 8, 2017

Related U.S. Application Data

(63) Continuation-in-part of application No. PCT/US2017/014735, filed on Jan. 24, 2017.

(51) Int. Cl.
*E04B 1/68* (2006.01)
*F27D 1/00* (2006.01)
*E04B 1/94* (2006.01)

(52) U.S. Cl.
CPC ..... *E04B 1/948* (2013.01); *E04B 1/6813* (2013.01)

(58) Field of Classification Search
CPC ..... E04B 1/948; E04B 1/6813; E04B 2/7411; E04B 2/7457
See application file for complete search history.

(56) References Cited

U.S. PATENT DOCUMENTS 4,811,529 A * 3/1989 Harris ..... E04B 1/6813 277/640
5,140,797 A 8/1992 Gohlke et al.
5,263,293 A 11/1993 Gohlke et al.
5,461,838 A * 10/1995 Heller ..... E04B 1/948 52/167.1

(Continued)

FOREIGN PATENT DOCUMENTS

CA 2691821 7/2011
CA 2631207 5/2016

(Continued)

OTHER PUBLICATIONS

U.S. Appl. No. 29/596,984, filed Mar. 13, 2017, InPro Corporation.

(Continued)

*Primary Examiner* — Brian D Mattei
(74) *Attorney, Agent, or Firm* — Reinhart Boerner Van Deuren s.c.

(57) ABSTRACT

A fire barrier assembly includes a fire barrier, mounting elements and securement elements. The mounting elements are positioned along the length of the fire barrier on an inner surface of the fire barrier. The mounting elements engage one or more of the securement elements to the fire barrier. When installed within an expansions space, the securement elements are used to tension mount the fire barrier assembly securely and generally immovably within the expansion space, without the need for any mechanical, adhesive, or other fixed connection to anchor the fire barrier assembly in (Continued)

place. As such, no modification to the building structures defining the expansion space (e.g. no drilling holes, applying adhesive, etc.) is need to mount the fire barrier assembly. If desired, the fire barrier assembly may easily be detached and removed from the expansion space.

20 Claims, 14 Drawing Sheets

(56) References Cited

U.S. PATENT DOCUMENTS

| | | | | |
|---|---|---|---|---|
| 5,765,332 | A * | 6/1998 | Landin | E04B 1/948 52/235 |
| 5,974,750 | A | 11/1999 | Landin et al. | |
| 6,112,488 | A * | 9/2000 | Olson | E04B 1/948 52/167.1 |
| 6,128,874 | A * | 10/2000 | Olson | E04B 1/948 52/232 |
| 6,131,352 | A | 10/2000 | Barnes et al. | |
| 7,856,781 | B2 | 12/2010 | Hilburn | |
| 7,941,981 | B2 | 5/2011 | Shaw | |
| 8,079,190 | B2 | 12/2011 | Hilburn | |
| 8,082,715 | B2 | 12/2011 | Shaw | |
| 8,245,471 | B2 | 8/2012 | Hilburn | |
| 8,397,453 | B2 | 3/2013 | Shaw | |
| 8,464,485 | B2 | 6/2013 | Hilburn | |
| 8,607,519 | B2 | 12/2013 | Hilburn | |
| 8,646,235 | B2 | 2/2014 | Hilburn | |
| 8,935,897 | B2 | 1/2015 | Shaw | |
| 2005/0066600 | A1 * | 3/2005 | Moulton | E04B 1/6813 52/393 |
| 2008/0263980 | A1 | 10/2008 | Shaw | |
| 2010/0319287 | A1 | 12/2010 | Shaw | |
| 2012/0117900 | A1 * | 5/2012 | Shaw | E04B 1/948 52/232 |

FOREIGN PATENT DOCUMENTS

| | | |
|---|---|---|
| CA | 2640007 | 2/2017 |
| WO | PCT/US17/14735 | 1/2017 |

OTHER PUBLICATIONS

Balco, Inc., product publication for Metaflex 5000 MetaMat Floor Fire Barrier, Oct. 31, 2011, 4 pages.

Meishuo Building Material, excerpt from a publication for fire barrier, publicly available at least by Nov. 17, 2015.

Balco, Inc. website material, MetaMat 2 Hour Floor, available at http://balcousa.com/product_category/expansion-joint-covers/fire-barriers/floor-fire-barrier/metamat-floor-fire-barrier/metamat-2-hour-floor/, illustrating products publicly available at least by Jan. 17, 2017, 8 pages.

International Search Report for International Application No. PCT/US2017/014735, dated Sep. 22, 2017, 12 pages.

* cited by examiner

TENSION MOUNTED FIRE BARRIER ASSEMBLY

CROSS-REFERENCE TO RELATED PATENT APPLICATION

This application is a continuation-in-part of International Patent Application No. PCT/US2017/014735, filed Jan. 24, 2017, which is incorporated herein by reference in its entirety.

FIELD OF THE INVENTION

The present application relates generally to fire barrier assemblies for installing in expansion spaces. The present application relates more specifically to fire barrier assemblies having securement elements configured to exert an outwardly directed force that presses the fire barrier into a tension mounted engagement with the building structures defining the expansion space, thereby reducing or eliminating the need for any permanent mechanical or adhesive elements to fixedly anchor the fire barrier assembly within the expansion space.

BACKGROUND OF THE INVENTION

Buildings and other structures are known to experience stress from many sources, such as extreme and/or repetitive changes in temperature, the force of high impinging winds, compression and expansion forces due to seismic events, settling of subsoil, building remodels, and excavation on or near the site. To minimize the effect of these stresses on the buildings or other structures, building codes specify that structures be constructed with spaces between adjacent wall, floor, and ceiling building units. These spaces, commonly referred to as "expansion spaces" or "expansion joint spaces," allow differential building movement to take place and mitigating damage to the structure, and thus are frequently referred to as "dynamic expansion spaces."

While expansion spaces improve the integrity of structures, they present a risk in the event of a fire because the channels created by the expansion spaces act as chimney flues providing pathways for gases, flame, and smoke to spread rapidly throughout the structure. To counter the flue effect, building codes for commercial or public structures generally require certified fire-barriers to be installed in the expansion spaces to reduce or prevent the spread of flames, smoke, and gas through the spaces into adjoining areas.

The installation of conventional fire barriers typically requires nailing, screwing in, bolting, gluing or otherwise fixedly anchoring the fire barrier to the building structures forming the expansion space via mechanical or adhesive fasteners. The installation of such conventional fire barriers is time consuming, labor intensive, may require special tools to anchor the fasteners into the building structure, and involves modifying and damaging (e.g. creating holes in or applying adhesive to) the building structure to secure the fire barrier assembly thereto.

Some conventional fire barriers may be formed with attachment portions configured to extend outside of the expansion space to allow the fire barrier to be anchored to an outer surface (e.g. top or bottom end) of the building structures. However, in many circumstances building specifications do not permit or allow for fire barriers to extend past and/or be attached to the outer surfaces (e.g. top or bottom end walls) of the building structures. In such situations, the fire barrier must be inside-mounted, with opposing sides of the fire barrier being anchored and secured to the building structures at anchor points located within the expansion space. As the expansion spaces between structures are typically narrow (in many circumstances only 1 to 2 inches wide), the anchoring of inside-mounted fire barriers to the inner surfaces of the expansion space may require additional time and effort to maneuver the required installation tools within the narrow space.

Additionally, conventional fire barriers typically are fixedly anchored to the building structure. The removal of, or even adjustment of the positioning of, the fire barrier may therefore be significantly hindered, and may altogether be impossible without damaging the fire barrier. Moreover, the bolts, pins, nails, screws, or other mechanical fasteners which are driven through the fire barrier to anchor the fire barrier to the building structures create openings or apertures in the fire barrier through which gases, flames, and smoke may be able to pass. As such, conventional fire barriers and the methods currently used for installing such fire barriers may reduce or diminish the efficacy of the fire barrier.

BRIEF DESCRIPTION OF THE DRAWINGS

This application will become more fully understood from the following detailed description, taken in conjunction with the accompanying figures, where like reference numerals refer to like elements in which.

SUMMARY OF THE INVENTION

Figure 1:
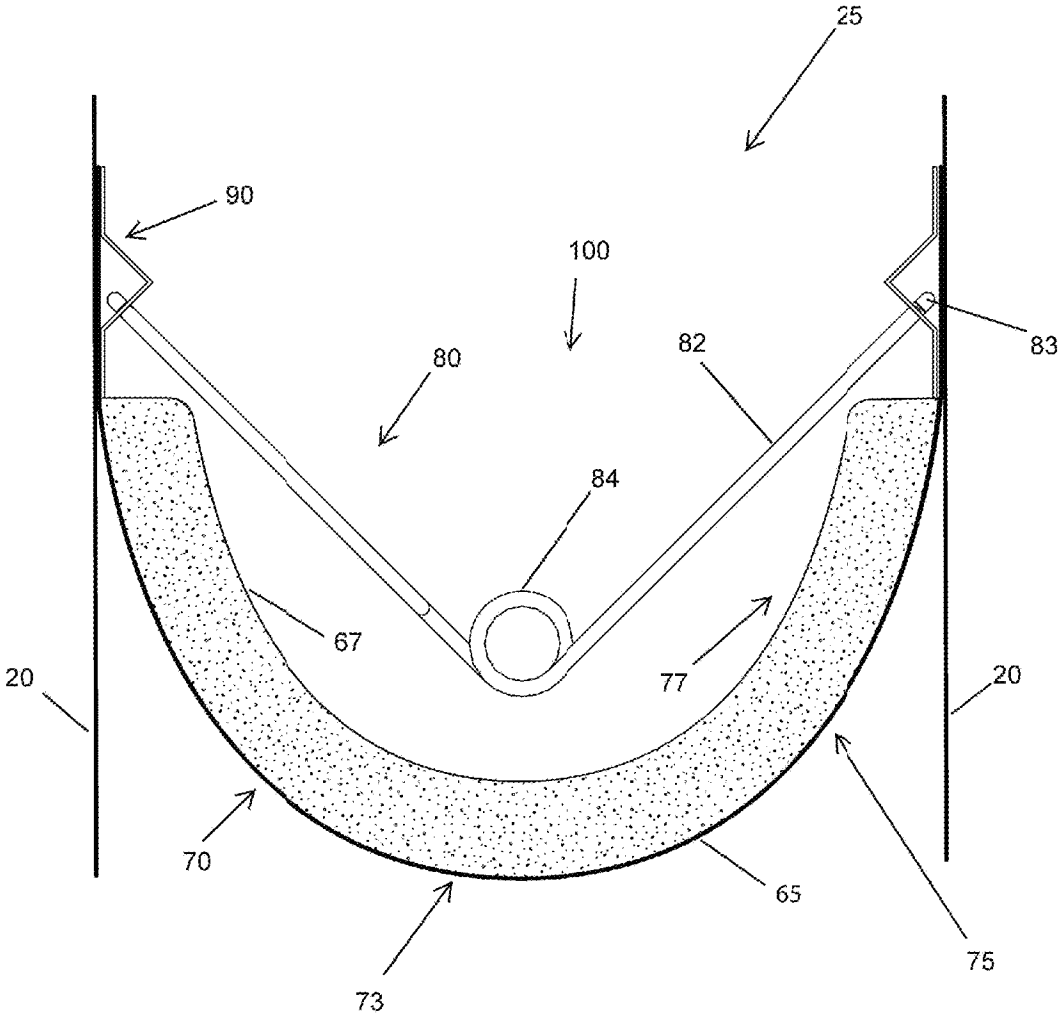
FIG. 1 is a cross-sectional view of a fire barrier assembly installed within an expansion space according to one embodiment.

In one embodiment, a fire barrier assembly includes a fire barrier having a top surface, a bottom surface, a front end, and a rear end. The length of the fire barrier is defined from the front end to the rear end of the fire barrier. First and second edges define opposite sides of the top surface. Each of the first and second edges extend from the front end to the rear end of the fire barrier along the top surface.

The fire barrier is configured to be formed into a mounting arrangement in which the first edge faces opposite and is substantially parallel to the second edge. The top surface forms an innermost surface of the fire barrier when the fire barrier is arranged in the mounting arrangement.

One or more mounting structures are attached to and are arranged along each of the first and second edges on the top surface of the fire barrier. The one or more mounting structures are positioned such that when the fire barrier is in the mounting arrangement, the mounting structures of the first edge are positioned at substantially the same location along the length of the fire barrier as the mounting structures of the second edge.

A plurality of securement elements are provided, with each securement element comprising first and second arms. The first arm is configured to attach to a first mounting structure located on the first edge of the fire barrier. The second arm is configured to attach to a second mounting structure located on the second edge.

A biasing member connects the first and second arms. The biasing member is configured such that the first and second arms are closer to one another when the basing member is in a stressed state than when the biasing member is in an unstressed state.

In one embodiment, an attachment assembly for a fire barrier comprises a mounting element having a pair of elongated mounting strips. Each mounting strip has an exterior surface configured for being fixedly attached to a fire barrier and an interior surface.

One or more mounting structures are formed along a length of the interior surface of the mounting strip. The spacing of the mounting structures on each of the mounting strips is substantially the same.

One or more securement elements are provided. Each securement element has first and second arms. Each arm has a base portion and an end portion. The end portion of each arm defines an engagement structure configured to interact with one of the mounting structures to secure the securement element to the mounting element.

A biasing element is attached to the base portions of the first and second arms. The biasing element is biased to force the end portions of the first and second arms away from one another.

In one embodiment a method of mounting a fire barrier assembly within an expansion space includes providing a fire barrier assembly. The fire barrier assembly includes a fire barrier arranged such that a left edge of a top surface of the fire barrier lies opposite and extends generally parallel to a right edge of the top surface of the barrier from a front end to a rear end of the fire barrier.

First and second elongated mounting strips are provided. The exterior surface of the first mounting strip is configured to be attached along at least a portion of the left edge of the top surface of the fire barrier. An exterior surface of the second mounting strip is configured to be attached along at least a portion of the right edge of the top surface of the fire barrier. The interior surfaces of each of the first and second mounting strips are formed with one or more mounting structures.

At least one securement element is provided. The securement element has first and second arms. The first arm of the securement element is configured to be attached to a mounting structure formed on the first mounting strip. The second arm of the securement element is configured to be attached to a mounting structure formed on the second mounting strip. The first and second arms of the at least one securement element are connected to one another by a biasing member.

The fire barrier assembly is positioned at a desired location within an expansion space defined by building structures. The fire barrier is secured at the desired location by an outwardly directed spring force exerted by the biasing member. No mechanical, adhesive or other fasteners besides the securement element are used to secure the fire barrier within the expansion space. The only engagement between the fire barrier assembly and the building structures is a tension mounted engagement resulting from the force exerted by the biasing member.

The mounting strips and the securement elements are attached to the fire barrier prior to positioning the fire barrier within the expansion space. The fire barrier, the first and second mounting strips and the at least one securement element assembly is provided as a preattached, ready-to-install unit to a user. Alternatively, in another embodiment the fire barrier and the first and second mounting strips are provided to a user separately, and a subsequently attached by the user.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Illustrated in FIG. 1 is one embodiment of an exemplary fire barrier assembly 100 installed within an expansion space 25 that is configured to reduce or prevent the spread of flames, smoke, and gas. As shown in FIG. 1, the fire barrier assembly 100 is configured to be securely and firmly mounted within, and generally immovable along the length of an expansion space 25 spanning between opposing, spaced, adjacent building structures 20, such as an expansion joint spaces extending between floor units, wall units, ceiling units, and a combination of units, for example a space created by spaced adjacent floor and wall units.

In contrast to conventional fire barriers and the installation of such conventional fire barriers, fire barrier assembly 100, such as illustrated in the exemplary embodiments of FIGS. 1-4B, does not require any fixed anchoring via mechanical or adhesive fasteners to building structures 20 to securely mount fire barrier assembly 100 within an expansion space 25. As shown in FIG. 1, the fire barrier assembly 100 is firmly supported within expansion space 25 via a tension engagement of the fire barrier assembly 100 with the building structures 20 defining the expansion space 25. Such tension engagement is provided by one or more securement elements 80 forming fire barrier assembly 100.

Once installed within an expansion space 25, the securement elements 80 of the fire barrier assembly 100 are in direct contact only with the other components of the fire barrier assembly 100. The securement elements 80 do not contact—and do not require any attachment, connection, abutment, or any other form of contact with—any portion of the building structures 20 defining expansion space 25, and/or any other components/structures/etc. besides the mounting element 90 and fire barrier 70 components of the fire barrier assembly 100.

As described in more detail below, the securement elements 80 are configured to force the sides 72, 74 of the fire barrier assembly 100 outwards to form a strong, secure, self-supporting interference/press-fit engagement of the fire barrier assembly 100 with the building structures 20. In contrast to the installation of conventional fire barriers, no modification (e.g. drilling holes, applying adhesive) of the building structures 20 is required to mount the fire barrier assembly 100 within the expansion space 25. Also, although tools may optionally be used for installation of the fire barrier assembly 100, the installation of the fire barrier assembly 100 may be done entirely by hand.

Furthermore, as the fire barrier assembly 100 is not fixedly anchored to the building structures 20 and the mounting of the fire barrier assembly 100 does not involve piercing, puncturing or otherwise damaging the fire barrier assembly 100, fire barrier assembly 100 may easily and effortlessly be repositioned within an expansion space 25, removed entirely, and even reused if so desired.

As discussed above, movement of building structures 20 may cause the width of an expansion space 25 to expand or contract. The fire barrier assembly 100 is configured such that, once installed, the fire barrier assembly 100 may move in a widthwise direction as the fire barrier assembly 100 expands or contracts to accommodate changes in the width of the expansion space 25. However, regardless of any movement of the fire barrier assembly 100 in a widthwise direction that may result from the expansion/compression of the expansion space 25, the fire barrier assembly 100 remains substantially immovable and stationary with respect to positioning of the fire barrier assembly 100 relative to the height of the building structures 20 of expansion space 25.

Figure 4A:
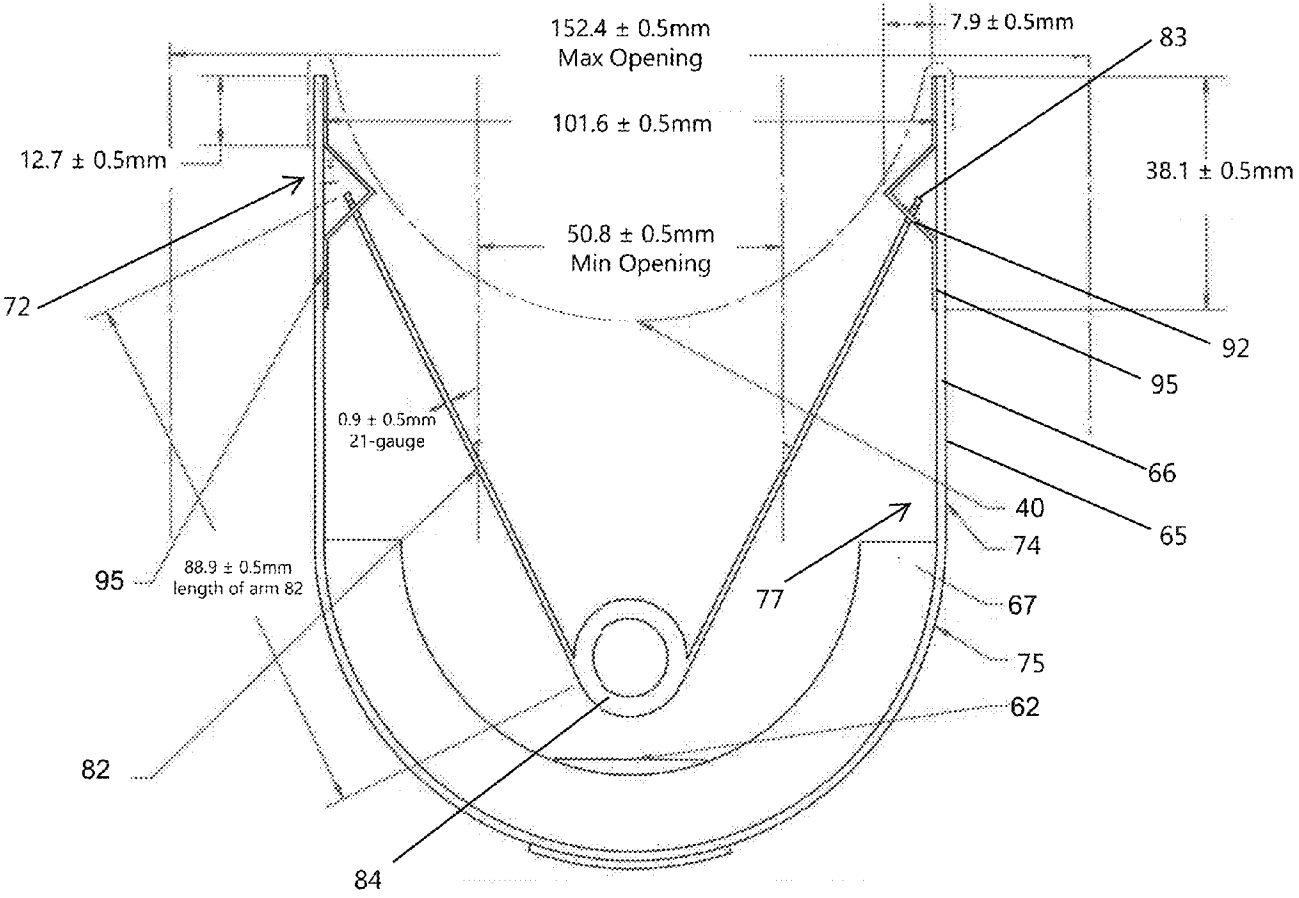
FIG. 4A is an end view of a fire barrier assembly according to one embodiment.
Figure 4B:
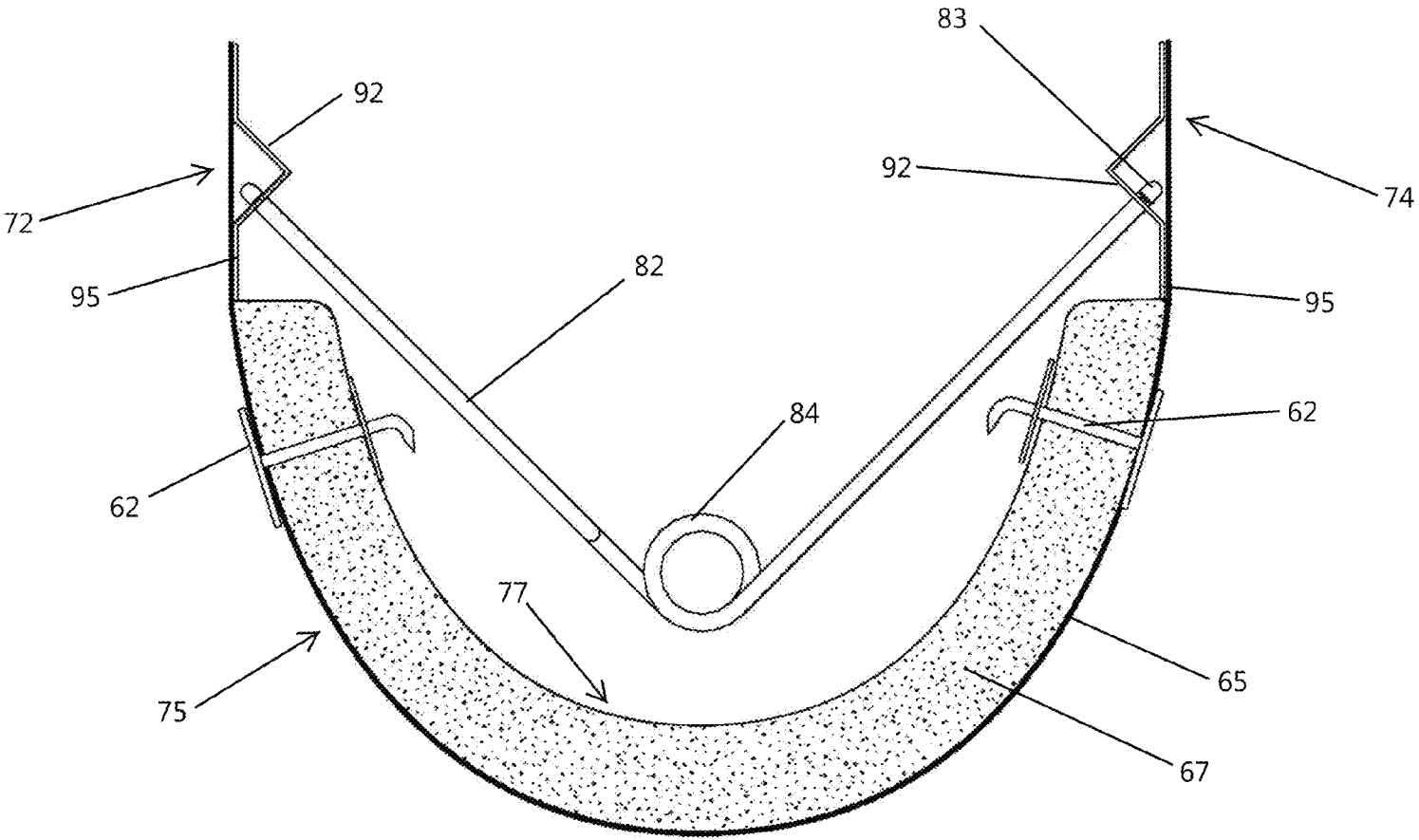
FIG. 4B is an end view of a fire barrier assembly according to one embodiment.
Figure 5:
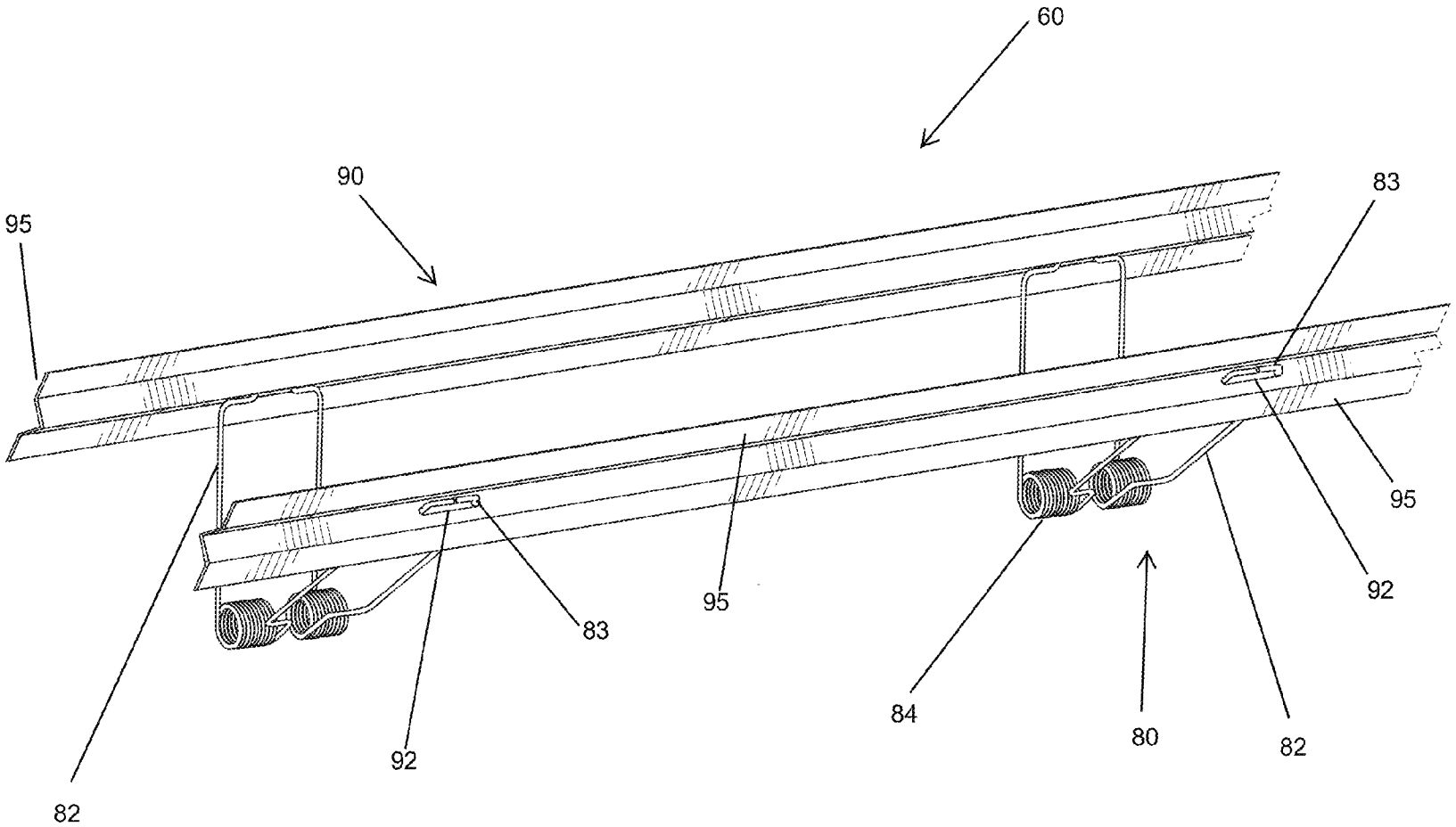
FIG. 5 is a top perspective view of an attachment assembly in which the mounting elements and securement elements are attached, according to one embodiment.

As illustrated by the various exemplary embodiments of fire barrier assembly 100 shown in FIGS. 1-4B, fire barrier assembly 100 comprises a fire barrier 70 and an attachment assembly 60. Shown in FIG. 5 is one embodiment of an attachment assembly 60 that may be incorporated into fire barrier assembly 100. As illustrated in FIG. 5, attachment assembly 60 comprises securement elements 80 and mounting elements 90 and is configured to mount and hold the fire barrier assembly 100 within an expansion space 25 following installation of the fire barrier assembly 100.

Although additional components may optionally be incorporated into the fire barrier assembly 100, in one embodiment fire barrier assembly 100 consists only of fire barrier 70, attachment assembly 60, and any connectors/adhesives/etc. required for joining the components of the fire barrier 70 and the attachment assembly 60 together and/or to one another to form the fire barrier assembly 100.

With regards to the fire barrier 70, the fire barrier 70 of the fire barrier assembly 100 is formed from a generally flat, rectangular structure. As shown in FIGS. 1-4B, the rectangular structure is folded, bent or otherwise arranged into a generally U-shape arrangement, having left and right sides 72, 74, with the bottom portions of the left and right sides 72, 74 connected to one another via a connector section 73. Connector section 73 can have any number of configurations, such that the fire barrier 70 may be defined by any number of cross-sectional shapes or geometries, e.g. rounded U-shapes, pointed V-shapes, etc.

Once arranged into the desired folded arrangement, the bottommost layer of the rectangular fire barrier 70 forms the outer surface 75 of the fire barrier 70 and fire barrier assembly 100, and the topmost layer of the rectangular structure forms the inner surface 77 of the fire barrier 70 and fire barrier assembly 100. As illustrated by the examples of FIGS. 1-4B, at least a portion of the left and right sides 72, 74 of the fire barrier 70 extend generally parallel to one another, with the inner surface 77 of left side 72 of the fire barrier 70 facing the inner surface 77 of the right side 74 of the fire barrier 70.

As illustrated by the various exemplary embodiments of fire barrier assemblies 100 shown in FIGS. 1-4B, fire barrier 70 may be formed of one or more layers of the same or varying materials. The number and composition of the layers of the fire barrier 70 may be varied depending on factors such as the composition and thickness of the material(s) forming the other layers of the fire barrier 70, the type of expansion space 25 in which the fire barrier assembly 100 will be mounted, the desired fire hour rating; the degree of fire-protection that is specified for the building, etc.

As described in more detail below, the fire barrier assembly 100 is held in place within expansion space 25 without the use of any mechanical or adhesive fasteners that anchor the fire barrier assembly 100 to the building structures 20. Thus, in addition to considerations regarding the composition and layering arrangement of the layers of the fire barrier 70 that may go into providing a fire barrier 70, other factors that may influence the design of fire barrier 70 include: weight minimization of the fire barrier 70; the sizing, particularly the width of the expansion space 25; the ability to attach or mount components (e.g. mounting element 90) to the different fire barrier 70 layers; the characteristics of the exterior surface of the building structure 20 to which the fire barrier assembly 100 will be mounted, etc.

As illustrated by the various embodiments of FIGS. 1-4B, based on these additional considerations, not only will the composition and arrangement of the layers of the fire barrier 70 vary depending on need, but the overall dimensions of the fire barrier 70 as well as the individual dimensions of each of the various layers may also vary when constructing fire barrier 70. Also, in some embodiments, the outer surface 75 of the fire barrier 70 may be formed/treated (e.g. scored) and/or may include additional gripping or other elements configured to increase the adherence of the fire barrier assembly 100 to building structures 20.

Materials that may be used to form one or more of the layers of the fire barrier 70 include, but are not limited to: woven fabrics, intumescent materials, insulation materials, metal, and protective cloths.

Woven fabrics are generally formed of fibrous materials, particularly pile fabrics or quilted battings, and have a high affinity for wicking and entrapping large amounts of moisture.

Intumescent materials are configured to expand (or intumesce) to several times their original size when activated by high temperatures to prevent the spread of flames and smoke.

Insulation or refractory blankets may be made from any number of insulation materials, including alumina, zirconia, and silica spun ceramic fibers, fiberglass, and the like. A scrim or backing layer may be provided and may be formed of a fire-resistant (refractory) metal or metallic foil, such as stainless steel foil.

Protective cloth is formed of flexible, strong, protective, refractory, woven material formed from amorphous silica yarns, polymeric material threads, fiber reinforced polymeric material threads, high-temperature resistant woven textiles, or a metalized, fiberglass cloth. The protective cloth is configured to mechanically support the insulation material and to protect the insulation material from mechanical damage.

Adjacent layers of the fire barrier 70 are attached to each other such that layers lie flat against one another to minimize or entirely prevent any dead space from being formed and/or air being trapped between the adjacent layers. In some embodiments, the fire barrier 70 layers may be attached to one another via one or more pins and/or pin/washer arrangements 62. As illustrated by the embodiments of FIGS. 4A and 4B, the pins and/or pin/washer arrangements 62 may be attached at various locations along the fire barrier 70. In other embodiments, adjacent layers of the fire barrier may be attached to each other via any other number of other mechanical attachments such as thread, staples, bolts, etc.

In other embodiments, adjacent layers of the fire barrier 70 may be joined using glue, double-sided tape, or any other adhesive connection. Unlike the use of mechanical attachments such as wire, staples, pins or bolts, the use of an adhesive connection between fire barrier 70 layers does not require piercing, puncturing, or otherwise permeating the layers of the fire barrier 70. As no holes are created in the layers of the fire barrier 70 when using an adhesive connection between adjacent layers, the migration of gases, flames, and smoke through the fire barrier is minimized.

Although as discussed above, fire barrier 70 may be formed having any number of layers (including one), as shown in FIGS. 1-4B, in various embodiment fire barrier 70 may be formed have two or more layers. In such multi-layer embodiments of fire barrier 70, the outer surface of the outermost layer 65 of fire barrier 70 defines the outer surface 75 of the fire barrier 70. The outermost layer 65 of the fire barrier 70 is directly exposed to the flames, heat, and gases of a fire from a lower floor. The inner surface 77 of fire barrier 70 is defined at least in part by an inner surface of an innermost layer 67. In some embodiments, for example as shown in the fire barrier 70 embodiments of FIGS. 2B and 4A, located in between outermost layer 65 and innermost layer 67 may be one or more middle layers 66.

Innermost layer 67 typically extends along the entire length of the fire barrier assembly 100. However, as illustrated in FIGS. 1-4B, in some embodiments the overall width of the innermost layer 67 may be less than the overall width of the outermost layer 65 and/or the middle layer(s) 66. Because in such embodiments the innermost layer 67 does not extend along the topmost portions of the left and right sides 72, 74 of the fire barrier 70, the inner surface 77 of the fire barrier along these topmost portions of the left and right sides 72, 74 of the fire barrier 70 is defined by middle layer 66 or outermost layer 65. In such embodiments where the innermost layer 67 is smaller than the middle layer 66 and/or outermost layer 65, the topmost portions of the left and right sides 72, 74 of the fire barrier 70 to which the innermost layer 67 is not attached are used as the mounting surfaces for attaching mounting element 90 to the fire barrier 70.

With regards to the attachment assembly 60, the attachment assembly 60 of the fire barrier assembly 100 generally comprises one or more securement elements 80 and one or more mounting elements 90. One example of an embodiment of securement elements 80 and mounting elements 90 forming an attachment assembly 60 is illustrated in FIG. 5.

Securement elements 80 are configured to exert a generally outwardly directed force, such that when the assembled fire barrier assembly 100 is mounted within an expansion space 25, the securement elements 80 push the sides of fire barrier assembly 100 outwards against the building structures 20, securing the fire barrier assembly 100 firmly in place via a tension-fit engagement of the fire barrier assembly 100 within the expansion space 25.

Figure 6A:
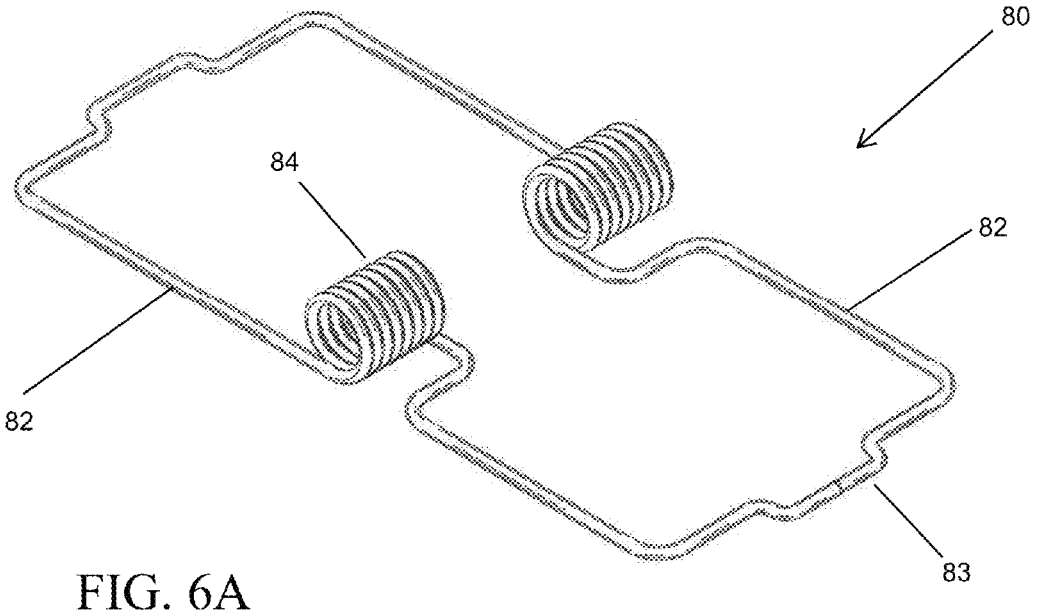
FIG. 6A is a top perspective view of a securement element in an unstressed, unbiased state according to one embodiment.
Figure 7A:
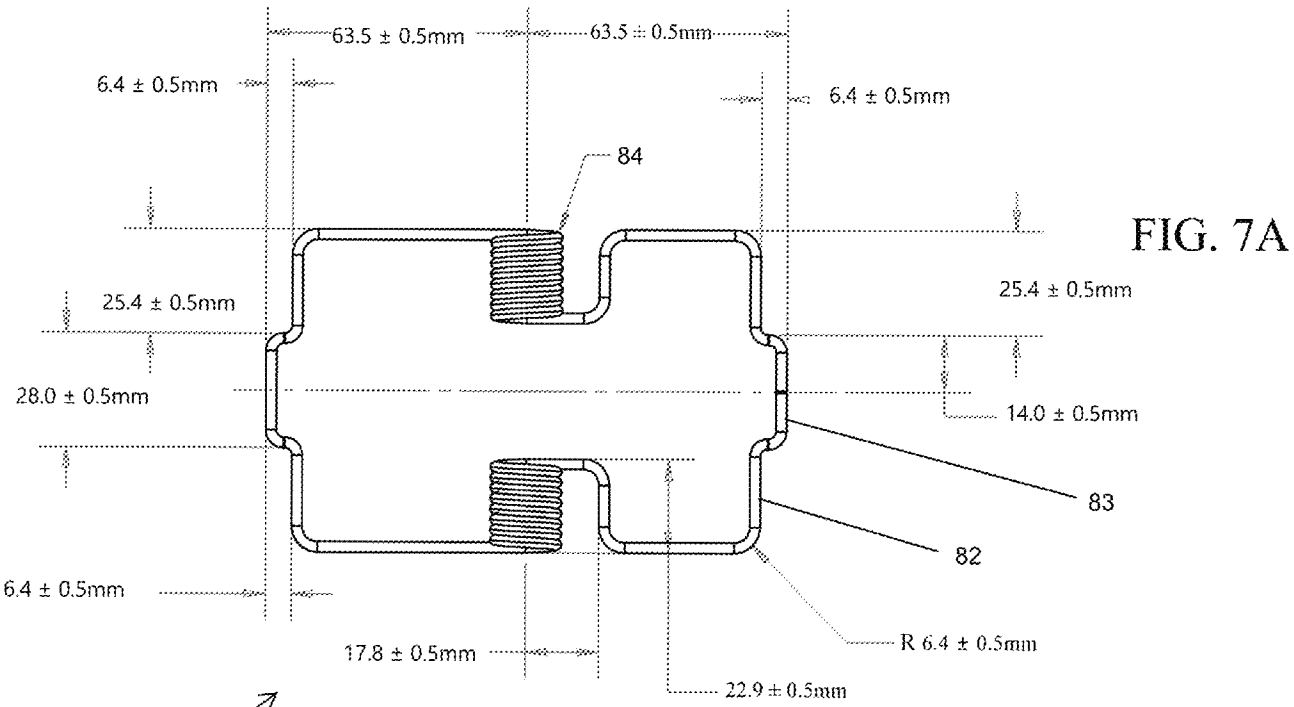
FIG. 7A is a top view of a securement element according to one embodiment.

Securement elements 80 comprise a pair of attachment elements, or arms 82. Extending between and connecting the arms 82 of each securement element 80 is a biasing member 84. As illustrated in FIGS. 6A and 7A, in some embodiments the arms 82 and biasing member 84 may be formed as an integral and even monolithic structure. In other embodiments, arms 82 and biasing member 84 may be formed as separate elements that are subsequently attached together to form securement elements 80. Arms 82 are sized and formed having shapes/configurations that allow for easy and quick, yet secure and steadfast, engagement of the arm 82 with the mounting structures 92 of the mounting elements 90.

Figure 8:
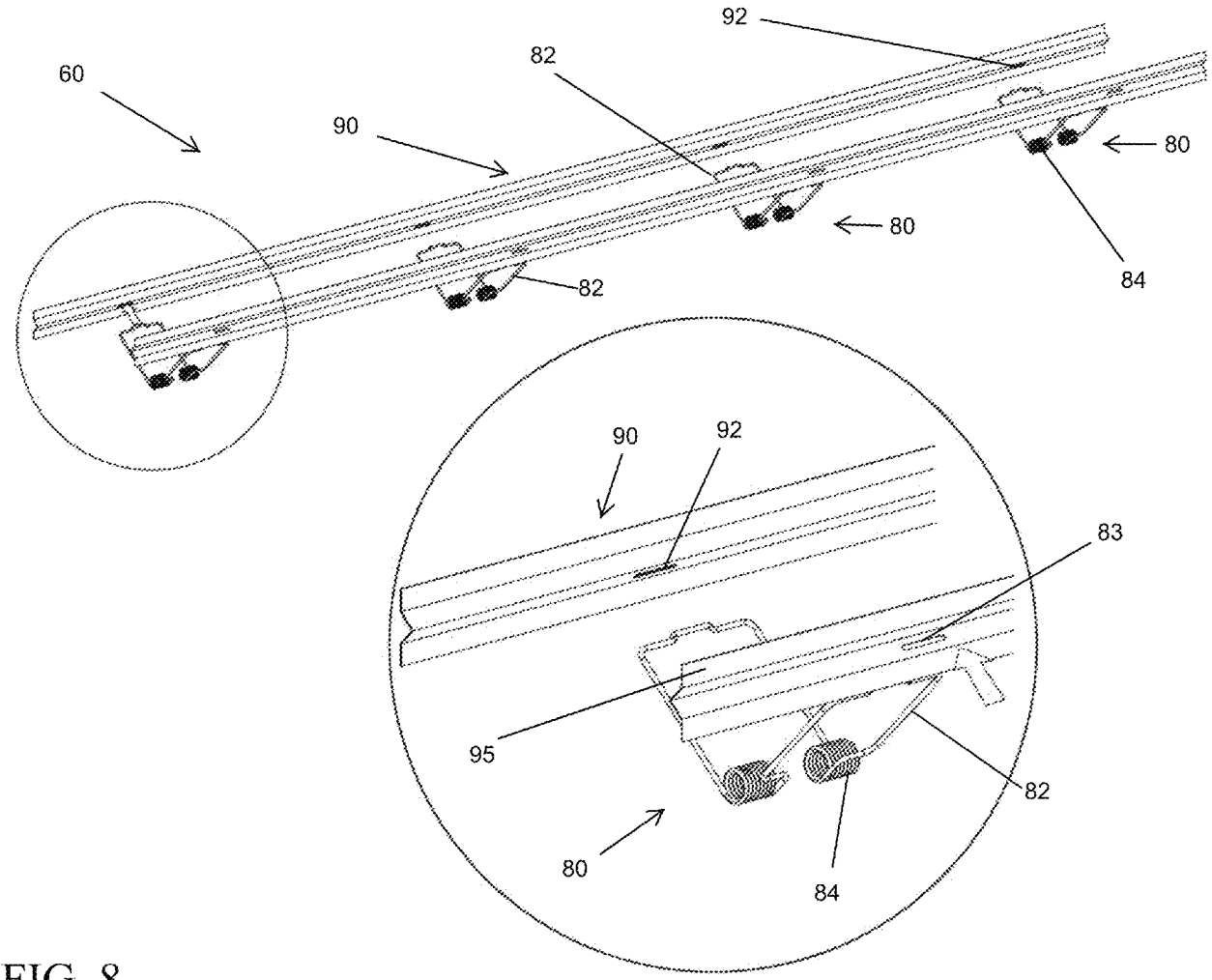
FIG. 8 is a top perspective view of an attachment assembly during engagement of the securement elements to the mounting elements, as well as an enlarged perspective view thereof, according to one embodiment.

Once securement elements 80 are attached to the fire barrier assembly 100 by engaging arms 82 with mounting structures 92 of the mounting elements 90, (one embodiment of which is illustrated in FIG. 8) movement of the arms 82 along/relative to the height of the fire barrier assembly 100 is substantially restricted or prevented. As such, when the fire barrier assembly 100 is installed within an expansion space 25, resulting in the compression of biasing member 84, the engagement of the arms 82 with mounting structures 92 prevents the resultant energy stored within biasing member 84 from forcing the securement element 80 out of engagement with the fire barrier assembly 100.

Biasing member 84 can comprise any number of elastic elements configured to exert a constant force and pressure onto arms 82 that pushes or biases arms 82 outwards and away from one another. As depicted by the embodiments of FIGS. 6A and 7A, in some embodiments biasing member 84 comprises a torsion spring. Examples of other biasing members 84 that may be used include compression springs, V springs, flat springs, etc.

In choosing a biasing member 84, factors such as: the overall weight of the fire assembly 100, the anticipated width of the expansion space 25, the pre-installation width and height of the fire barrier assembly 100, the characteristics of the exterior surface of the building structures 20 to which the fire barrier assembly 100 will be mounted, etc. are considered so as to provide a biasing member 84 having properties (for example stiffness and resilience) that will allow the securement element 80 to exert sufficient force over an extended period of time to firmly and securely maintain the fire barrier assembly 100 in a fixed position relative to the original mounting location along the height of the building structures 20 defining expansion space 25.

Figure 6B:
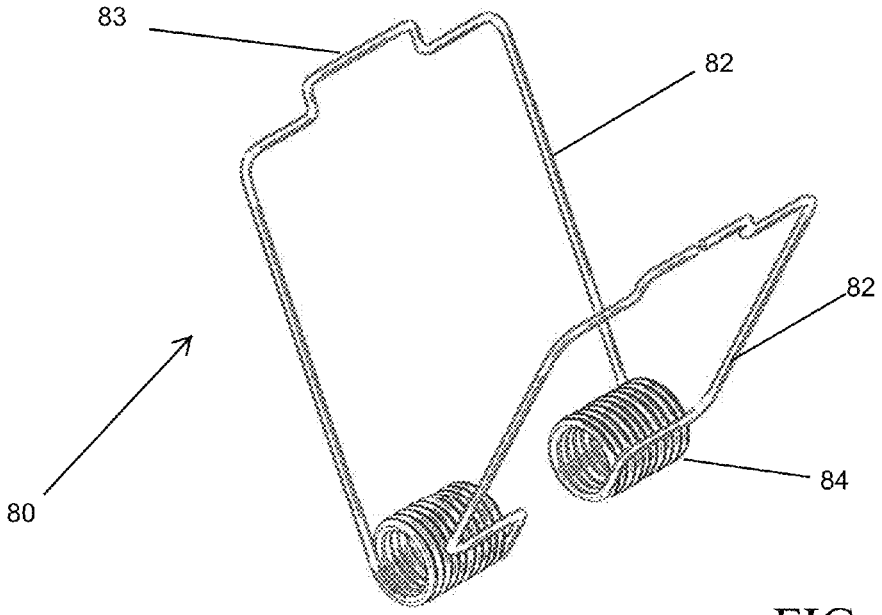
FIG. 6B is a top perspective view of the securement element of FIG. 6A in a compressed state.
Figure 6C:
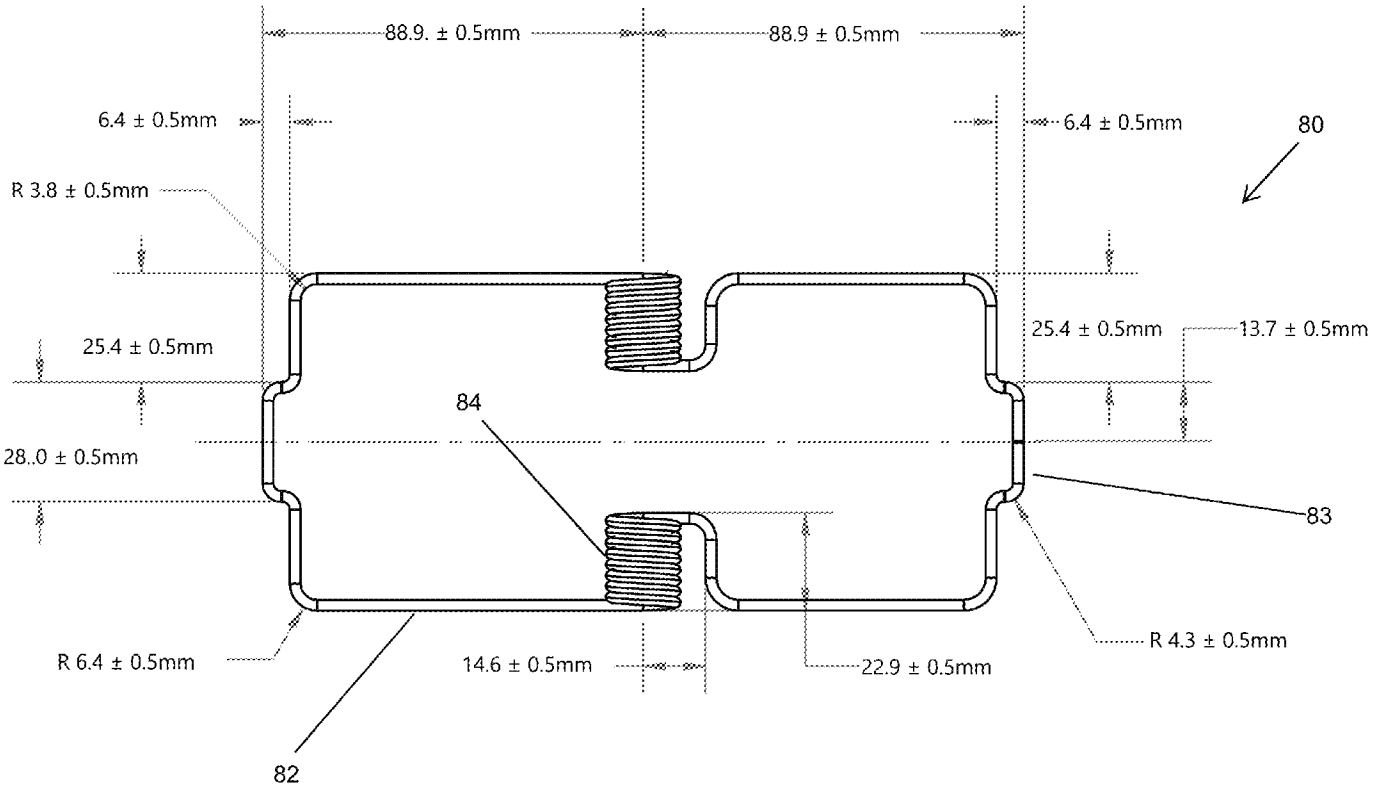
FIG. 6C is a top view of the securement element of FIG. 6A.
Figure 6D:
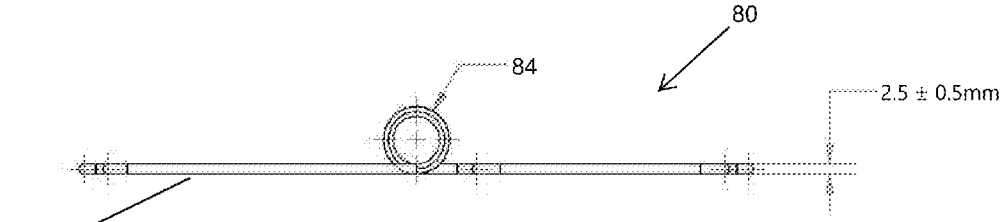
FIG. 6D is a side view of the securement element of FIG. 6A.
Figure 7B:
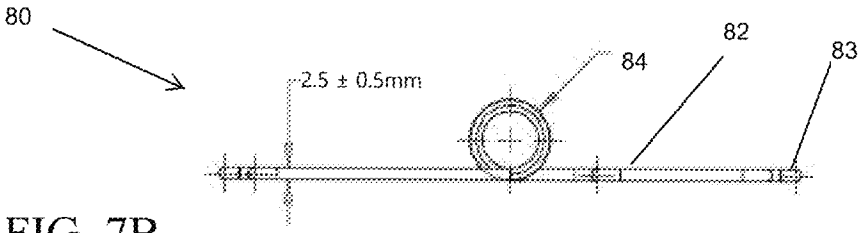
FIG. 7B is a side view of the securement element of FIG. 7A.

Referring to FIGS. 6B and 7B, detailed views of securement elements 80 according to two embodiments are shown. The embodiments of the securement elements 80 shown FIGS. 6B and 7B comprise monolithically formed arms 82 and biasing member 84. In other embodiments, the securement elements 80 may be formed as separate arm 82 and biasing member 84 components that are subsequently joined together. In one embodiment, the securement elements 80 of the embodiments of FIGS. 6B and 7B may be formed of a 300-series stainless steel. In other embodiments, the securement elements 80 may be formed of a different type of stainless steel, or of an entirely different type of resilient and elastic material.

The biasing member 84 of each of the embodiments of FIGS. 6B and 7B comprises a torsion coil hinge spring. Although the torsion springs of the embodiments of FIGS. 6B and 7B are illustrated as having two spaced apart eight-coil segments, other embodiments of coil hinge springs may incorporate segments having fewer or more than eight coils. As discussed previously and as illustrated by the comparison of the embodiments of the coil hinge spring securement elements 80 of FIGS. 6B and 7B, the dimensions of the securement element 80 may be varied depending on the required or desired characteristics of the securement element 80.

Figure 2A:
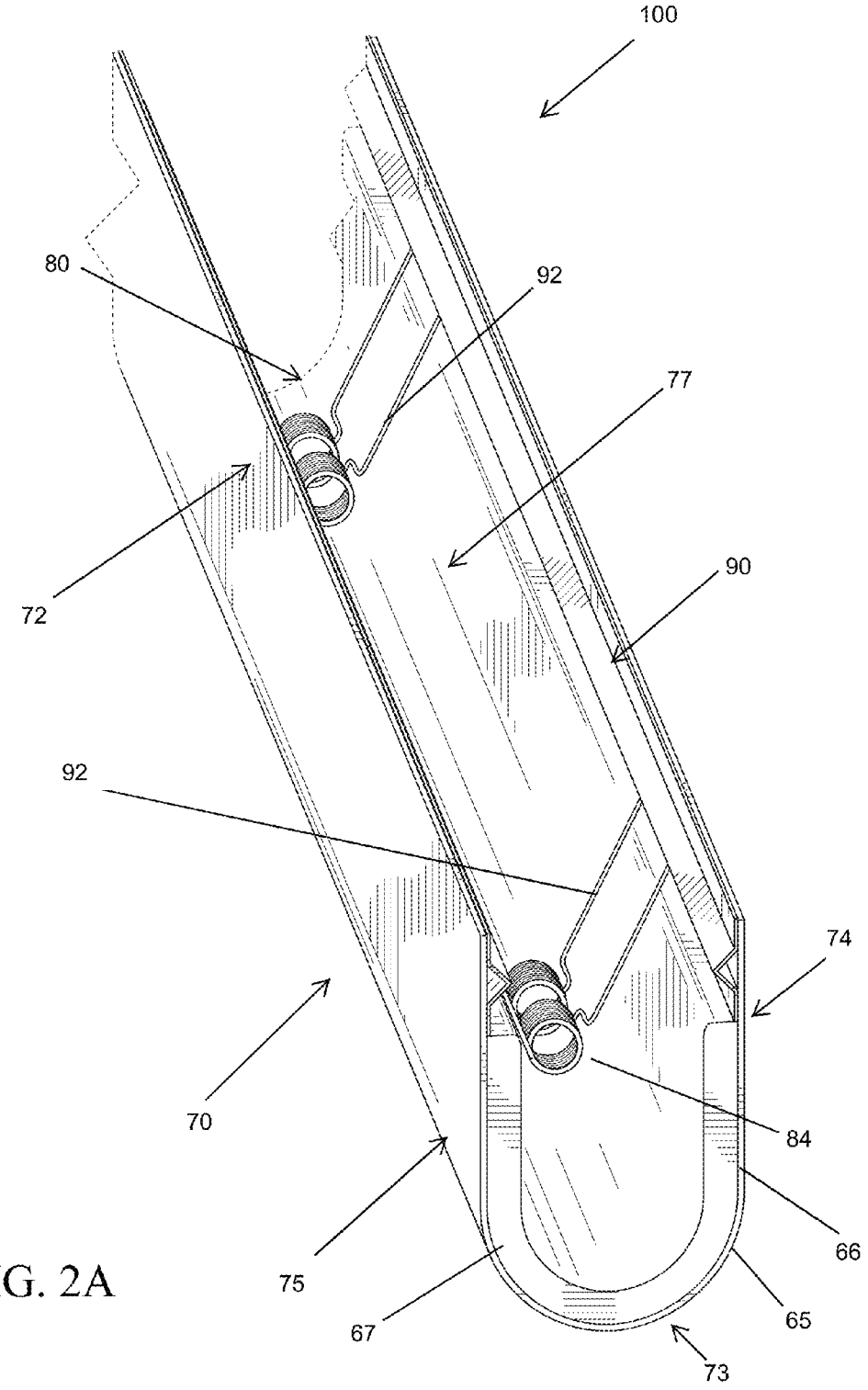
FIG. 2A is a top perspective view of a fire barrier assembly according to one embodiment.
Figure 2B:
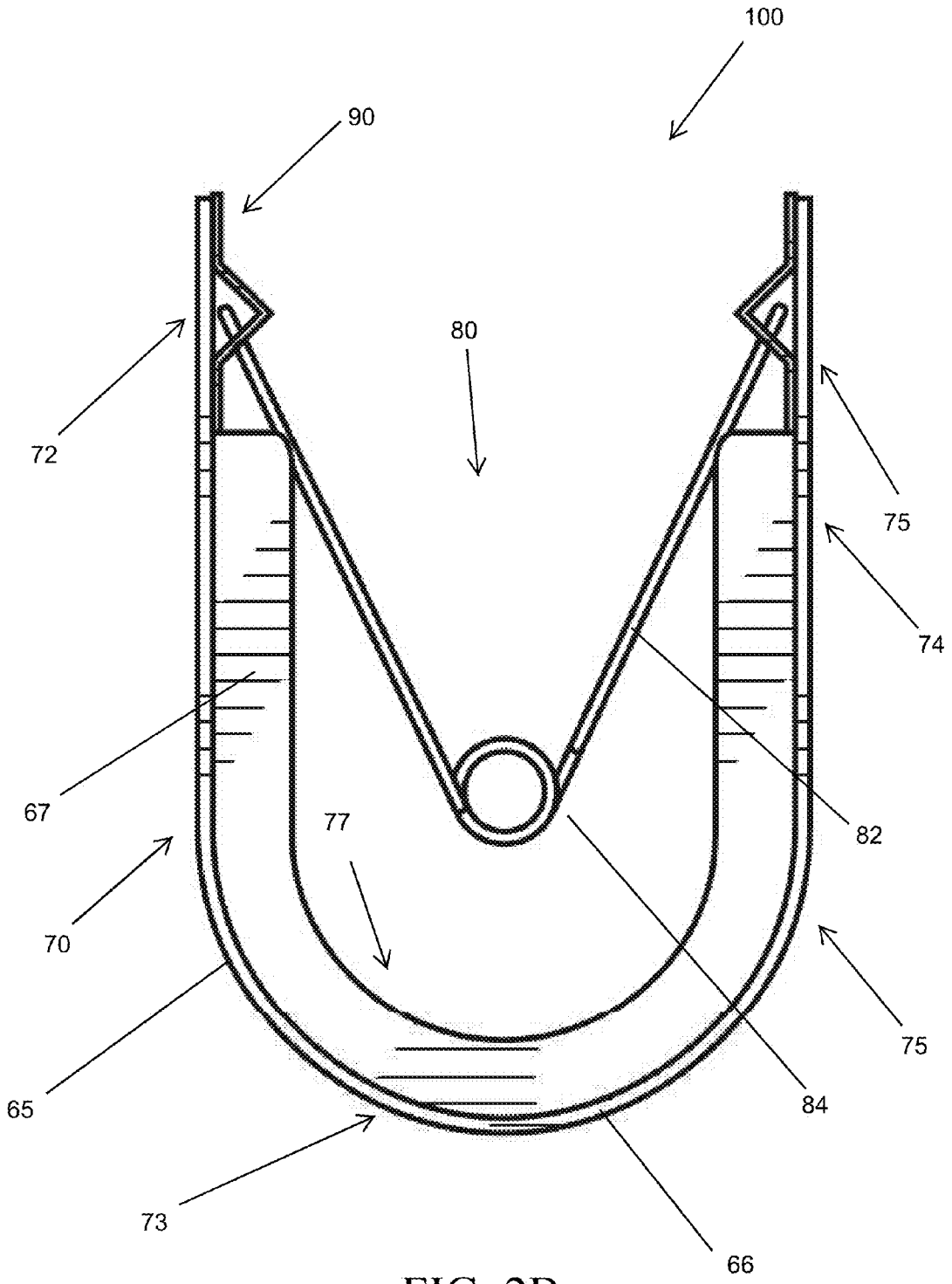
FIG. 2B is an end view of the fire barrier assembly of FIG. 2A.
Figure 3:
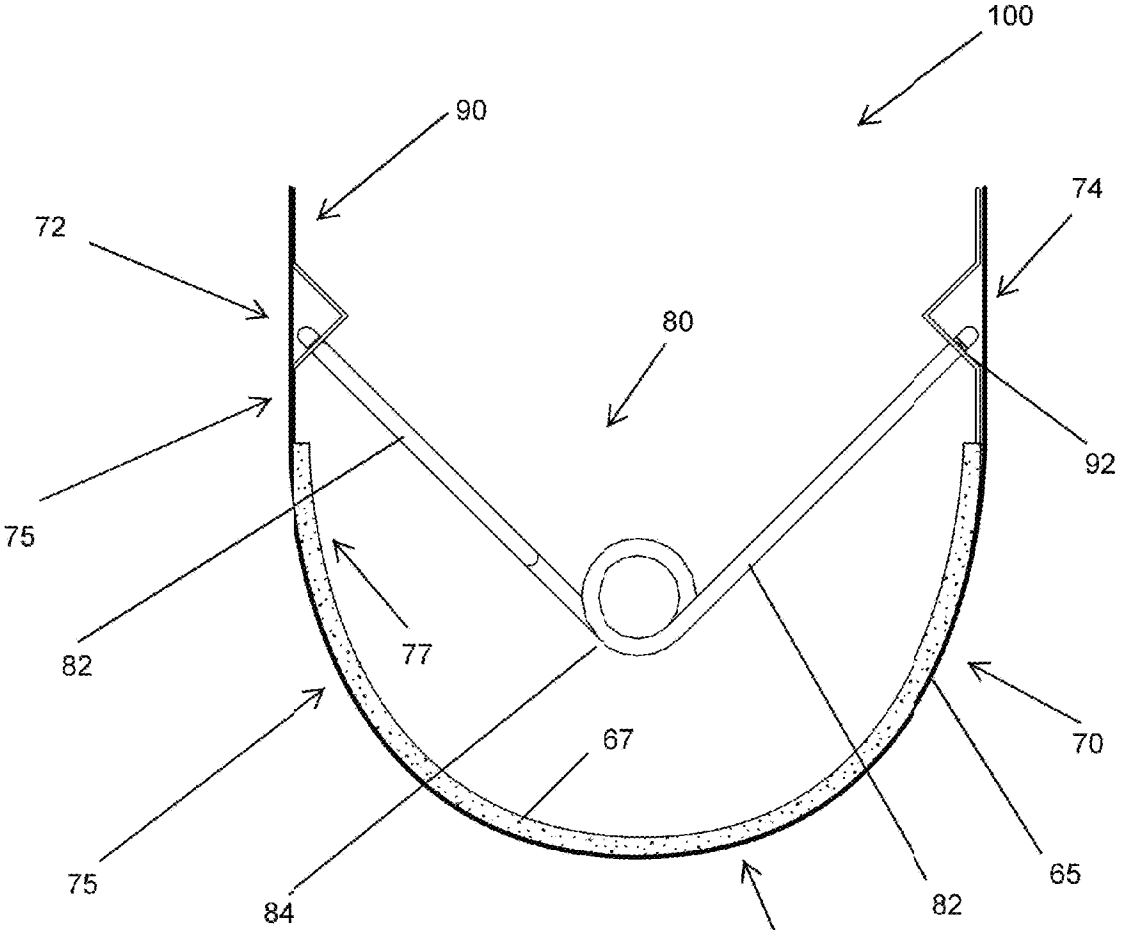
FIG. 3 is a cross-sectional view of a fire barrier assembly according to one embodiment.

Referring to FIGS. 2A, 5 and 8, in some embodiments, securement element 80 may comprise a plurality of discrete securement elements 80 configured to be spaced at various positions along the length of the fire barrier 70. In other embodiments, securement element 80 may be formed as a single, elongated securement element 80 configured to extend along a substantial or entire length of the fire barrier 70.

With reference to mounting element 90, mounting elements 90 are configured to affix securement elements 80 to the fire barrier 70, such that the outwardly directed force exerted by biasing members 84 can be transferred through arms 82 onto the sides 72, 74 of fire barrier 70, thus allowing the fire barrier assembly 100 to be mounted within expansion space 25.

Figure 9A:
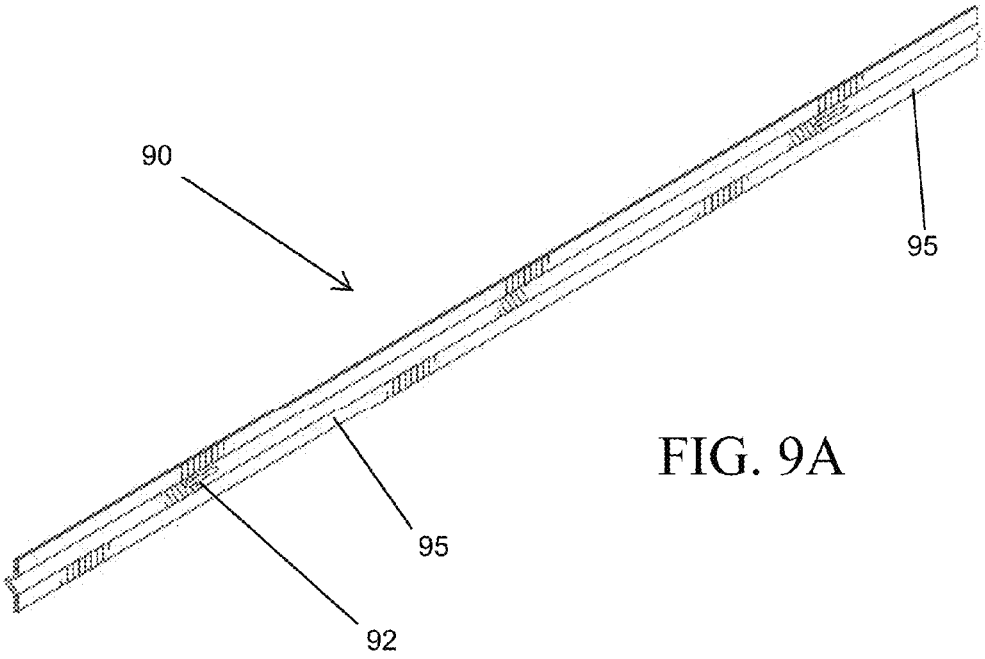
FIG. 9A is a top perspective view of a mounting element according to one embodiment.
Figure 9B:
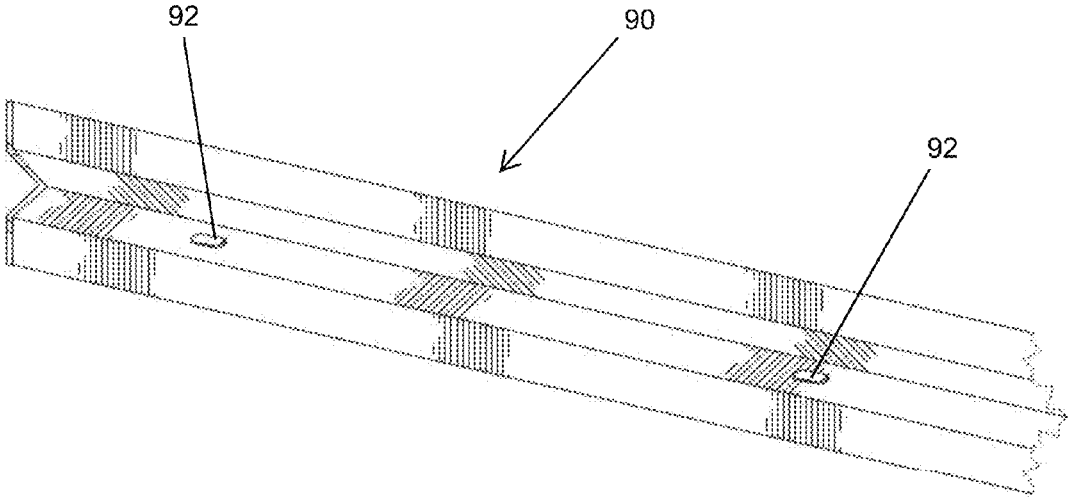
FIG. 9B is another perspective view of the mounting element of FIG. 9A.

Shown in FIGS. 9A and 9B is one embodiment of a mounting element 90 that may be incorporated into fire barrier assembly 100. The mounting elements 90 may be affixed at any height along each side 72, 74 of the fire barrier 70. Typically, the positioning and location at which the mounting element 90 of one side 72, 74 is attached will mirror the positioning and location at which the mounting element 90 of the other side, 74, 72 is located. In other embodiments, the positioning of the mounting elements 90 on sides 72, 74 will not mirror one another. The mounting elements 90 may extend along the length of the fire barrier 90 at any height along the height of the sides 72, 74. In one embodiment, the mounting elements 90 extend along the fire barrier 70 at or adjacent to the top edge of sides 72, 74.

As illustrated by the embodiment of FIG. 9A, at least a portion of the outer surface of mounting element 90 defines one or more mounting surfaces 95 configured for fixed attachment to the inner surfaces 77 of left and right sides 72, 74 of fire barrier 70. In some embodiments, at least a portion of mounting surfaces is generally flat and planar. Mounting surfaces 95 may optionally comprise or be formed to have a surface structure (e.g. gripping members, scores, etc.) that may improve adherence of the mounting element 90 to the fire barrier 70. Mounting surfaces 95 may be attached to fire barrier using any number of know attachments, such as, e.g. adhesive, glue, double-sided tape, pins, staples, thread, wire, etc.

Formed on the inner surface of mounting element 90 along each side 72, 74 of fire barrier 70 are one or more mounting structures 92 configured to engage with arms 82 of securement elements 80 to attach the securement elements 80 to fire barrier assembly 100. Additionally, the interaction between mounting structures 92 and arms 82 is configured to prevent the securement elements 80 from inadvertently being pushed out of engagement with the fire barrier assembly 100 as a result of the energy stored in biasing member 84 when the securement elements 80 are compressed.

Mounting structures 92 and the respective portion of arms 82 configured to interact with mounting structures 92 may be configured and formed in any number of ways. As illustrated in FIGS. 9A and 9B in one embodiment, mounting structures 92 may comprise slots formed in mounting element 90 that are configured to receive corresponding tabs 83 of the exemplary securement elements 80 of embodiments of FIGS. 6A and 7A, such as illustrated in FIG. 8. Other mounting structures 92 may be formed as inwardly extending abutment ledges configured to interact with a top surface of arms 82, elastic clips (e.g. Terry clips), flanges, hooks, retaining grooves, etc.

In some embodiments, mounting structures 92 are configured to securely engage arms 82 in a releasable or removeable manner, allowing securement elements 82 to be detached from fire barrier assembly 100 if needed. In other embodiments, mounting structures 92 may be formed with an additional structure or member (e.g. inwardly angled tabs formed about the periphery of the mounting structure 92 slots of the embodiment illustrated in FIGS. 9A and 9B) that would fixedly engage arms 82 to mounting structure 92 and thereby significantly hinder or entirely prevent the removal or disengagement of securement elements 80 from mounting element 90.

In some embodiments, some or all of the outer surface of mounting element 90 may be covered by intumescent or any other fire barrier material. Although mounting element 90 is shown in the embodiments of FIGS. 1-4B as being secured to the inner surface 77 of fire barrier 70, in some embodiments, mounting element 90 may be layered within the layers of the fire barrier 70 and attached to a surface other than the inner surface, with only the surfaces of the mounting structures 92 not being covered by the fire barrier 70.

In one embodiment, each mounting element 90 extends uninterruptedly from the front end to the rear end of the fire barrier 70. Located on the uninterruptedly extending mounting elements 90 of the left and right sides 72, 74 of the fire barrier are one or more mounting structures 92. In other embodiments, mounting element 90 comprises a plurality of discrete mounting elements 90 that are spaced along the length of fire barrier 70 on left and right sides 72, 74. Located on each discrete mounting element 90 could be one or more mounting structures 92.

Mounting structures 92 may be formed along the fire barrier 70 at any desired intervals. The intervals between each of the mounting structures 92 may be uniform along the fire barrier 70, or may be varied. The spacing between adjacent mounting structures may depend on any number of factors, for example, the weight of the fire barrier assembly 100, the dimensions of the fire barrier assembly 100, the dimensions of the expansion space 25, the characteristics of the exterior surfaces of the building structures 20 defining the expansion space 25, the characteristics (e.g. resilience, stiffness, etc.) of the biasing member 84, etc.

In one embodiment, adjacent mounting structures 92 may be spaced every 10 to 30 inches along the length of the fire barrier 70, specifically between 15 to 25 inches, and more preferably between 18 to 21 inches apart.

Referring to FIG. 4A, one exemplary embodiment of a fire barrier assembly 100 is discussed in detail. In the fire barrier assembly 100 embodiment of FIG. 4, outermost layer 65 comprises a thin stainless steel foil or scrim backing layer. The backing layer covers the outer surface of a thin middle layer 66 formed of an intumescent material. In shown in FIG. 4, the intumescent material has a thickness of 0.060±0.03 inches. In the embodiment of FIG. 4, the innermost layer 67 comprises an insulated blanket, such as e.g. a DURABLANKET ceramic blanket having a thickness of approximately 0.50±0.03 inches.

The innermost layer 67 is approximately 6.0±0.75 inches wide (as measured along a top surface of the innermost layer 67 from the leftmost edge to the rightmost edge). As shown in FIG. 4A, the width of innermost layer 67 is significantly less than the width of the middle layer 66 and outermost layer 65. As illustrated in FIG. 4A, the layers of the fire barrier 70 are attached to one another via one or more pins 62. In other embodiments, the layers may alternatively, or additionally, be attached to one another via a spray adhesive or double sided tape.

The mounting elements 90 of the embodiment of FIG. 4A are formed of 26-gauge galvanized metal, and are attached to the intumescent middle layer 66 via a double sided-tape. In some embodiments, such as illustrated in FIG. 4A, extending over the top opening of fire barrier assembly 100 is a vapor barrier 40, such as the rFOIL reflective vapor barrier.

In some embodiments, the fire barrier assembly 100 may be provided as a preassembled fire barrier 70/mounting element 90 unit. In one embodiment, the preassembled fire barrier 70/mounting element 90 unit may be provided in a preloaded installation tool. In other embodiments fire barrier 70 and mounting element 90 may be provided as separate elements, which are assembled by the user prior to use.

In some embodiments, it may be possible to retrofit existing fire barriers with mounting elements 90 and securement elements 80, in which case the mechanical anchoring fasteners of the conventional fire barrier may be replaced with the mounting elements 90 and securement elements 80 described herein.

In some situations, for example where a user may wish to reinforce the existing conventional anchored attachment of a previously installed conventional fire barrier, the securement of the fire barrier within the expansion space 25 may be reinforced using mounting elements 90 and securement element 80 instead of reinforcing the existing anchored attachment with additional mechanical anchoring fasteners.

Although securement elements 80 are configured to be capable of being engaged to mounting element 90 manually without the use of any tools, various tools may optionally be provided to decrease the time and effort required to engage the securement elements 80 to the mounting structures 92 of the fire barrier assembly 100.

In one embodiment, a positioning tool (not shown) is attached to two or more securement elements 80. The spacing of the securement elements 80 along the positioning tool matches the spacing of the mounting structures 92 formed along the length of the fire barrier assembly 100. By providing securement elements 80 in a spaced arrangement that corresponds to the spacing of the mounting structures 92, the time and effort required to engage securement elements 80 to the fire barrier assembly 100 may be significantly reduced.

Specifically, by aligning the first securement element 80 attached to the positioning tool with the first mounting structure 92 of the fire barrier 70, the remaining securement elements 80 are automatically aligned at locations along the fire barrier assembly 100 also corresponding to mounting structures 92. Once the securement elements 80 and mounting structures 92 are aligned, the securement elements 80 are engaged with the mounting structures 92. Thus, the positioning tool may save time that may have otherwise have spent locating the mounting structures 92 to which the securement elements 80 need to be engaged.

In one embodiment, the positioning tool remains attached to the securement elements 80 even after the securement elements 80 have been joined to the mounting structures 92. In other embodiments, the securement elements 80 are detachably connected to the positioning tool so that the positioning tool may be removed after the securement elements 80 have been positioned at their desired location.

An engagement tool (not shown) may also optionally be provided to facilitate the engagement of one or more securement elements 80 with mounting structures 92. In embodiments of an engagement tool configured for the simultaneous attachment of multiple securement elements 80, the engagement tool may optionally be used in conjunction with a positioning tool. In another embodiment, a multi-securement element 80 engagement tool may be configured with the features of a positioning tool, allowing for simultaneous positioning and installation of multiple securement elements 80 to a fire barrier 70 using a single tool.

In one embodiment, the engagement tool may comprise a retractable/hinged sleeve that, prior to installation of the one or more securement elements 80 envelops and compresses arms 82 together, allowing the securement element 82/engagement tool to be inserted through the top opening 71 of fire barrier 70. Once inserted within the fire barrier 70 and positioned such that securement elements 80 are adjacent mounting structures 92, the sleeve is retracted/opened, allowing the biasing member 84 to force arms 82 outward and into engagement with the mounting structures 92.

In one embodiment, the engagement tool may comprise one or more handles or grips attached to and extending above a base portion to which securement elements 80 are initially attached. Once the securement elements 80 have been loaded onto the engagement tool, the base portion loaded with securement elements 80 may be pressed/forced downwards using handles to insert the securement elements 80 into the fire barrier 70 and into engagement with the mounting element 90. Once securement elements 80 have been installed, the handles and optionally the base portion of the engagement tool are detached from the securement elements 80 and the engagement tool is removed from the fire barrier assembly 100.

The tools used to position/attach securement elements 80 can be formed having any desired length. In one embodiment, the length of the tools can be substantially equal to the length of the fire barrier 70, thereby allowing the positioning and/or attachment of all the securement elements 80 at the same time. In other embodiments, the length of the tools may be shorter than the length of the fire barrier assembly 100, with the number of securement elements 80 simultaneously positioned/attached by the tool being less than the number of mounting structures 92 provided on the fire barrier assembly 100. In one embodiment, the tool may be configured for installation of individual securement elements 80.

In embodiments in which securement element 80 positioning and/or engagement tools are utilized, the tool(s) and securement elements 80 may be provided as a preassembled/preloaded ready to use unit. In other embodiments, the tool(s) and securement elements 80 may be provided separately, requiring the securement elements 80 to be attached to/loaded into the tool by the user prior to use. In some embodiments, the tool may be reusable, allowing the tool to be reloaded for subsequent use after installation of an initial set of securement elements 80.

In one embodiment, securement elements 80 and mounting element 90 may be provided as a preassembled unit. The preassembled securement element 80/mounting element 90 unit may optionally be provided preloaded in an attachment tool configured to assist in loading the securement element 80/mounting element 90 unit into the fire barrier 70 and in attaching the mounting element 90 to the inner surfaces 77 of the sides 72, 74 of the fire barrier 70.

In one embodiment, the securement elements 80 and mounting element 90 are formed as separate elements connected via mounting structures 92 such as described above, and which are provided (and optionally preloaded in an installation tool) with the securement elements 80 preattached to the mounting element 90. In another embodiment, the arms 82 of securement elements 80 may be integrally formed with the mounting element 90, obviating the need for separate mounting structures 92. The integral attachment of arms 82 and mounting element 90 may be formed in any number of ways, e.g. adhesion, using fasteners, welding, etc. In some embodiment, the arms 82 and mounting elements 90 may be monolithically formed as a single integral unit. In such an embodiment, the integral securement element 80/mounting element 90 unit may be provided preloaded within an installation tool.

In yet another embodiment, instead of both the left and right arms 82 of the securement elements 80 being provided preattached to and/or integrally formed with the mounting element 90, only the arms 82 of one side (i.e. left of right) are provided preattached to and/or integrally formed with the mounting element 90. As the securement elements 80 will already be provided and positioned at the required engagement locations along the length of the fire barrier assembly 100, engagement of the securement elements 80 to the fire barrier assembly 100 will only require the user to engage the free side of arms 82 to the mounting structures 92.

In some embodiments in which the securement elements 80 are provided preattached to and/or integrally formed with mounting element 90, not all of the securement elements 80 are preattached to/integrally formed with mounting element 90 prior to installation of the fire barrier assembly 100. In such embodiments, once the fire barrier assembly 100 has been positioned at a desired location within the expansion space 25, the remaining securement elements 80 are engaged to mounting structures 92.

In one embodiment, the fire barrier 70 (with or without mounting element 90 attached) is installed within an expansion space 25 prior to engagement of the securement elements 80 to the fire barrier 70. The fire barrier 70 is loaded into the expansion space 25 either manually (i.e. without the use of any tools) or utilizing a fire barrier installation tool and positioned at a desired location within the expansion space 25, at which point the installation tool (if utilized) is removed.

Once properly positioned, if not already attached, the mounting element 90 is attached to the fire barrier 70, following which the securement elements 80 are engaged to the fire barrier assembly to firmly and securely fasten to the fire barrier assembly 100 at the desired location. In another embodiment, if mounting element 90 is not initially attached to the already installed fire barrier 70, the mounting element 90 and securement elements 80 are attached to the fire barrier simultaneously. The securement elements 80 and, if needed mounting element 90, may be attached manually or using one or more tools.

In one embodiment, an entirely preassembled fire barrier assembly 100 is provided to a user, allowing for a one-step installation process. In such an embodiment, mounting elements 90 are attached to fire barrier 70 and the securement elements 80 are engaged to the mounting structures 92 prior to the fire barrier assembly 100 being provided to the user, so that installation of the fire barrier assembly 100 with an expansion space 25 is a one-step process. Although such an entirely preassembled fire barrier assembly 100 is configured to be capable of being installed entirely by hand, in one embodiment the entirely preassembled fire barrier 100 may be provided preloaded within an installation tool.

Although the fire barrier assembly is configured to be mountable within expansion space 25 without the use of any tools, tools may optionally be used to assist in fire barrier assembly 100 installation. In one embodiment, installation tool may comprise a retractable or hinged sleeve configured to compress the fire barrier assembly 100 sufficiently to allow the fire assembly 100 to be moved to a desired location within the expansion space 25. Once properly positioned, the sleeve is retracted/disengaged and the installation tool removed. With the constraining sleeve removed, the fire barrier assembly 100 is forced outwards and into engagement with building structures 20 by the biasing member 84. In addition to facilitating installation by making movement of the fire barrier assembly 100 within expansion space 25 easier, the sleeve based installation tool acts to protect the outer surface 75 of the fire barrier assembly 100 from being torn, scratched, or otherwise damaged as the fire barrier assembly 100 is moved within the expansion space 25 to its desired position.

Figure 10A:
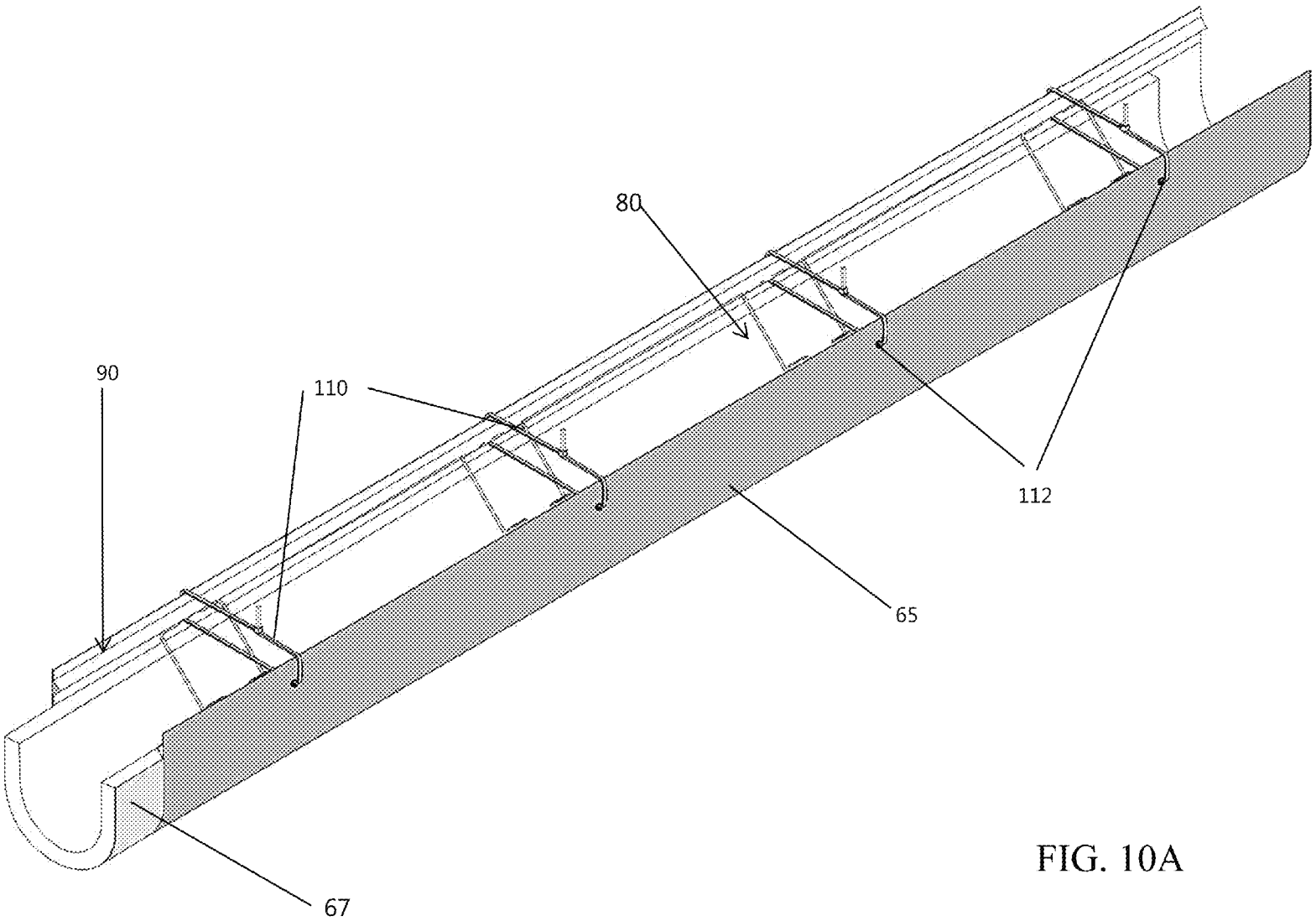
FIG. 10A is a top perspective view of a preassembled fire barrier assembly in a first configuration according to one embodiment.

In order to facilitate installation and positioning of the fire barrier assembly 100 within an expansion space 25, in one embodiment an installation tool in the form of one or more strings, straps, adhesive or other tape, film, bands, ties, or other binding elements 110 configured to compress the fire barrier assembly 100 may be provided. As shown in FIG. 10A, in one embodiment the binding element 110 may comprise one or more zip-ties.

The binding element 110 is configured to encircle at least a portion of the fire barrier assembly 100 so as to be able to apply a force to the fire barrier assembly 100 sufficient to compress the fire barrier assembly 100 into a ready-for-installation configuration. In such a ready-for-installation configuration the width of the fire barrier assembly 100 is narrower than the width of the expansion space 25 into which the fire barrier assembly 100 is to be installed. In some embodiments, additional installation tools may be utilized to install the fire barrier assembly 100 in conjunction with the use of binding elements 110.

In some embodiments, the binding element 110 may encircle the entire exterior periphery of the fire barrier assembly 100. In other embodiments, such as illustrated for example in FIGS. 10A and 10B, the binding element 110 may extend about only a portion of fire barrier assembly 100.

Figure 10B:
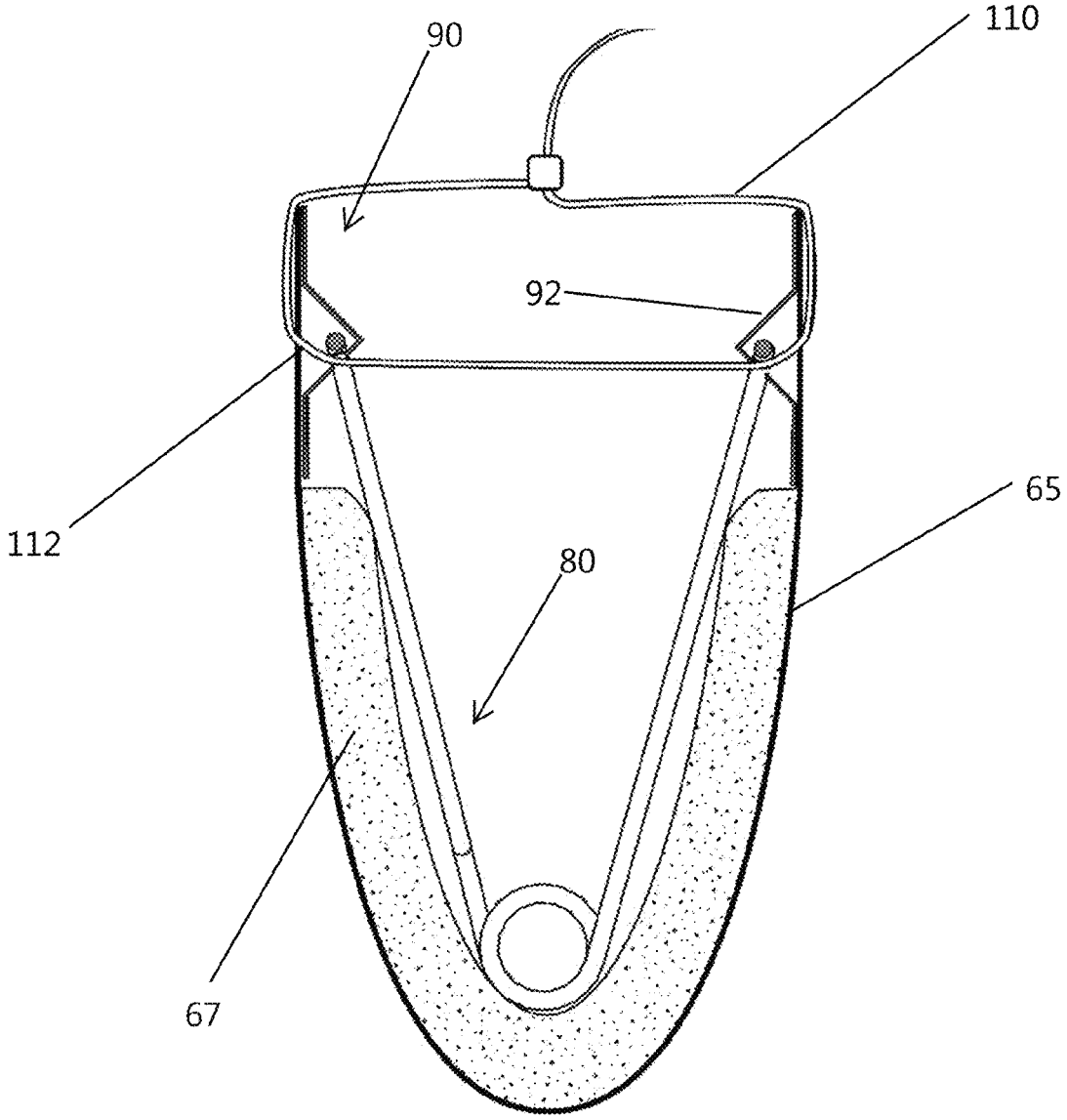
FIG. 10B is a cross-sectional view of the preassembled fire barrier assembly of FIG. 10A in second configuration according to one embodiment.

The fire barrier assembly 100 may optionally be formed to include one or more attachment structures, e.g. grooves in the exterior surface of the fire barrier 70, hooks, flanges, etc. to which the binding element 110 may more easily and/or securely be attached. As illustrated in FIGS. 10A and 10B, in one embodiment, apertures 112 may be provided along the upper edges of the left and right sides 72, 74 of the fire barrier 70 along locations corresponding to the locations of the apertures defined in mounting structures 92. As illustrated in FIG. 10B, apertures 112 and the apertures of defined in mounting structures 92 allow for a zip-tie binding element 110 to pass through and encircle the upper portion of the fire barrier assembly 100.

Referring to FIG. 10A, a fully assembled fire barrier assembly 100 with an attached binding element 110 is illustrated in a partially compressed configuration. In the partially compressed configuration shown in FIG. 10A, the tightness of the binding elements 110 about fire barrier assembly 100 is such that the degree of compression/bias of the securement elements 80 corresponds to or is less than the degree of compression/bias of the securement elements 80 once the fire barrier assembly 100 is installed within an expansion space 25. In this partially compressed configuration, the width of the fire barrier assembly 100 is generally equal to or greater than the width of the expansion space 25 into which the fire barrier assembly 100 is to be installed.

Illustrated in FIG. 10B is the fire barrier assembly 100 in a ready-for-installation configuration. In this ready-for-installation configuration, the binding element 110 constrains the fire barrier assembly 100 with a force sufficient to compress the width of the fire barrier assembly 100 to a width narrower than the width of the expansion space 25 into which the fire barrier assembly 100 is to be installed.

Once a fire barrier assembly 100 in a ready-for-installation configuration such as shown in FIG. 10B is positioned in its desired location within an expansion space 25, a user may cut, untie, or otherwise break the binding element 110. With the fire barrier assembly 100 no longer constrained by the binding element 110, the securement elements 80 bias the fire barrier assembly 100 outwards and into engagement with the walls defining the engagement space 25. Once undone, the binding element 110 may optionally be removed from the fire barrier assembly 100 by the user.

In one embodiment, the fire barrier assembly 100 and binding element 110 may be provided to a user as separate components. The user may subsequently attach the binding element 110 to the fire barrier 100, optionally utilizing attachment structures such as, for example, apertures 112 to do so. Once attached to the fire barrier, the user may tighten the binding element 110 to constrain the fire barrier assembly 100 into a configuration having a desired degree of compression.

In another embodiment, a preassembled fire barrier assembly 100 with an at least partially preattached binding element 110 is provided to a user in a first uncompressed configuration. In this first uncompressed configuration, there is no or minimal constraint of the fire barrier assembly 100 by the binding element 110, such that the securement element 80 is in an unbiased, relaxed rest state. Once the user is ready to install the fire barrier assembly 100, the user uses the at least partially preattached binding element 110 to compress the fire barrier assembly 100 to a desired ready-for-installation configuration.

In one embodiment, a preassembled fire barrier assembly 100 is provided to a user in a partially compressed configuration, such as, for example, the configuration illustrated by the embodiment of FIG. 10A. In such an embodiment, an initial compressive force imparted by binding element 110 constrains the fire barrier assembly 100 such that the width of the fire barrier assembly 100 is equal to or greater than the width of the expansion space 25 into which the fire barrier assembly 100 is to be installed. Once the user is ready to install the fire barrier 100, the user tightens the binding element 100 to further compress the fire barrier assembly 100 into the desired narrower, ready-for-installation configuration.

In another embodiment, the preassembled fire barrier assembly 100 is provided to a user with the binding element 100 constraining the fire barrier assembly 100 in a desired ready-for-installation configuration, allowing the user to install the fire barrier assembly 100 without having to adjust the degree of tightness of the binding element 110 prior to doing so. In addition to, or as an alternative to, being used to constrain an assembled fire barrier assembly 100 to facilitate installation, the binding element 110 may optionally be used with other components of the fire barrier assembly 100. For example, as described previously, in some embodiments securement elements 80 and mounting elements 90 are provide separate from the fire barrier 70. Once the fire barrier 70 has been positioned at a desired location within an expansion space 25, the securement elements 80 and mounting element 90 are inserted into the expansion space 25 and attached to the fire barrier 70 to install the fire barrier assembly 100 within the expansion space 25. In such an embodiment, one or more binding elements 110 may be used to constrain the securement elements 80 and mounting element 90 as they are inserted into the expansion space. Once the securement elements 80 and mounting element 90 are aligned with the fire barrier 70, the binding element 110 may be cut, untied, opened or otherwise unconstrained.

The fire barrier assemblies 100 illustrated herein depict straight-line fire barriers, which are configured to be installed in the expansion spaces 25 between straight, continuous, parallel, segments of walls, ceilings, or floor units. However, it is to be understood that the fire barrier assembly 100 may be formed in any number of other linear or non-linear configurations, thus allowing the fire barrier assembly 100 to be mounted within expansion spaces 25 defined by any number of geometries or configurations.

Additionally, fire barrier assembly 100 may be formed in a branched or cross-shaped configuration (also known as expansion space intersecting configurations) such that the fire barrier assembly 100 may be mounted within and used in any number of geometrically complex spaces created by the intersection of two or more expansion spaces 25. Examples of intersecting joint spaces include the cross-shaped intersection space that results from the intersection of two straight-line expansion spaces 25 that intersect at a 90-degree angle, or where the joint space between two spaced adjacent interior walls abuts the space between an exterior wall and one or more spaced adjacent interior walls creating an "L" or "T"-shaped intersection space.

The cross sections of the fire barrier assemblies 100 illustrated herein are depicted generally being the same along the length of the fire barrier assembly 100, such that the front and rear ends of the fire barrier assembly 100 are generally identical. However, as illustrated for example by the embodiment of the fire barrier assembly 100 of FIG. 10A, it is understood that the front and rear ends of the fire barriers 70 may be formed having different, but complimentary end shapes (e.g. a male/female configuration of the front and rear ends) that are configured to allow the rear end of a first fire barrier assembly 100 to be interlocked, coupled, or otherwise connected to the front end of a second fire barrier assembly 100.

As described herein, fire barrier assembly 100 is formed and configured to be entirely self-supporting when installed within an expansion space 25 (i.e. the fire barrier assembly 100 requires no additional elements or attachments to securely mount the fire barrier assembly 100 within the expansion space 25, nor does the fire barrier assembly 100 have to be anchored to the building structure 20 in any way to securely support the fire barrier assembly 100 within the expansion space 25). However, it is understood that, if a user so desired, the securement of the fire barrier assembly 100 within the expansion space 25 could be reinforced by anchoring the fire barrier assembly 100 to the building structure 20 via adhesives, mechanical fasteners, or any additional elements.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only.

Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein.

Some elements shown as integrally formed may be constructed of multiple parts or elements, the position of elements may be reversed or otherwise varied, and the nature or number of discrete elements or positions may be altered or varied.

The order or sequence of any process, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one.

Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures.

Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

We claim:

1. An attachment assembly for a fire barrier comprising:
- a mounting element comprising a pair of elongated mounting strips, each mounting strip having:
  - an exterior surface configured for being fixedly attached to a fire barrier;
  - an interior surface, the interior surface of each mounting strip being defined by an angled downwardly extending wall and an angled upwardly extending wall; and
  - a plurality of mounting structures formed along a length of the interior surface of each mounting strip, the spacing of the mounting structures on each of the mounting strips being substantially the same; and
- one or more securement elements, each securement element having:
  - first and second arms, each arm having a base portion and an end portion;
  - the end portion of each arm defining an engagement structure configured to interact with one of the mounting structures to secure the securement element to the mounting element; and
  - a biasing element attached to the base portions of the first and second arms, wherein the biasing element is biased to force the end portions of the first and second arms away from one another.

2. The attachment assembly of claim 1, wherein the mounting structures are formed on the upwardly extending walls of the mounting strips.

3. The attachment assembly of claim 2, wherein the mounting structures comprise slots formed in the upwardly extending walls of the mounting strips.

4. The attachment assembly of claim 3, wherein the engagement structures of the arms comprise tabs.

5. The attachment assembly of claim 1, wherein the biasing member is a torsion spring.

6. The attachment assembly of claim 1, wherein the biasing member and the first and second arms are formed as an integral, monolithic structure.

7. A fire barrier assembly comprising:
- a fire barrier; and
- an attachment assembly, the attachment assembly comprising:
  - a mounting element comprising a pair of elongated mounting strips, each mounting strip having:
    - an exterior surface;
    - an interior surface, the interior surface of each mounting strip being defined by an angled downwardly extending wall and an angled upwardly extending wall; and
    - a plurality of mounting structures formed along a length of the interior surface of each mounting strip, the spacing of the mounting structures on each of the mounting strips being substantially the same; and
  - one or more securement elements, each securement element having:
    - first and second arms, each arm having a base portion and an end portion;
    - the end portion of each arm defining an engagement structure configured to interact with one of the mounting structures to secure the securement element to the mounting element; and
    - a biasing element attached to the base portions of the first and second arms, wherein the biasing element is biased to force the end portions of the first and second arms away from one another.

8. The fire barrier assembly of claim 4, the fire barrier being formed of a generally rectangular substrate having a top surface, a bottom surface, a front end, a rear end, a first edge and a second edge;

wherein the fire barrier is defined by a configuration of the substrate in which a portion of the top surface of the substrate extending along the first edge is arranged to face opposite and substantially parallel to a portion of the top surface of the substrate extending along the second edge.

9. The fire barrier assembly of claim 8, wherein the exterior surface of a first mounting strip forming the pair of mounting strips is attached along the portion of the top surface of the substrate extending along the first edge, and the exterior surface of the second mounting strip forming the pair of mounting strips is attached along the portion of the top surface of the substrate extending along the second edge.

10. The fire barrier assembly of claim 7, wherein the mounting structures are formed on the upwardly extending walls of the mounting strips.

11. The fire barrier assembly of claim 10, wherein the mounting structures comprise slots formed in the upwardly extending walls of the mounting strips.

12. The fire barrier assembly of claim 7, wherein the engagement structures of the arms comprise tabs.

13. The fire barrier assembly of claim 7, wherein the biasing member is a torsion spring.

14. An attachment assembly for a fire barrier comprising:

a mounting element comprising a pair of elongated mounting strips, each mounting strip having:

an exterior surface configured for being fixedly attached to a fire barrier;

an interior surface, the interior surface of each mounting strip being defined by an angled downwardly extending wall and an angled upwardly extending wall; and a plurality of mounting structures formed along a length of the interior surface of each mounting strip, the spacing of the mounting structures on each of the mounting strips being substantially the same; and one or more securement elements, each securement element having:

first and second arms, each arm having a base portion and an end portion;

the end portion of each arm defining an engagement structure configured to interact with one of the mounting structures to secure the securement element to the mounting element; and a biasing element attached to the base portions of the first and second arms, wherein the biasing element is biased to force the end portions of the first and second arms away from one another;

wherein the biasing element comprises a torsion spring.

15. The attachment assembly of claim 14, further comprising a fire barrier having a folded configuration defined by an outer surface and an inner surface, the fire barrier being arranged such that a portion of the inner surface extending along a first free edge of the fire barrier is parallel to and faces opposite a portion of the inner surface extending along a second free edge of the fire barrier.

16. The attachment assembly of claim 15, wherein the exterior surface of a first mounting strip forming the pair of mounting strips is attached along the portion of the inner surface of the fire barrier extending along the first free edge of the fire barrier.

17. The attachment assembly of claim 16, wherein the exterior surface of the second mounting strip forming the pair of mounting strips is attached along the inner surface of the fire barrier extending along the second free edge of the fire barrier.

18. The attachment assembly of claim 14, wherein the mounting structures are formed on the upwardly extending walls of the mounting strips.

19. The attachment assembly of claim 18, wherein the mounting structures comprise slots formed in the upwardly extending walls of the mounting strips.

20. The attachment assembly of claim 14, wherein the engagement structures of the arms comprise tabs.

* * * * *